US008491181B2

(12) United States Patent
Fujiwara et al.

(10) Patent No.: US 8,491,181 B2
(45) Date of Patent: Jul. 23, 2013

(54) CHRONOGRAPH TIMEPIECE

(75) Inventors: Toshiyuki Fujiwara, Chiba (JP); Tamotsu Ono, Chiba (JP); Shigeo Suzuki, Chiba (JP); Masayuki Kawata, Chiba (JP)

(73) Assignee: Seiko Instruments Inc. (JP)

( * ) Notice: Subject to any disclaimer, the term of this patent is extended or adjusted under 35 U.S.C. 154(b) by 250 days.

(21) Appl. No.: 12/931,410

(22) Filed: Jan. 28, 2011

(65) Prior Publication Data

US 2011/0194382 A1 Aug. 11, 2011

(30) Foreign Application Priority Data

Feb. 3, 2010 (JP) ..... 2010-022404
Dec. 6, 2010 (JP) ..... 2010-271809

(51) Int. Cl.
*G04F 8/00* (2006.01)

(52) U.S. Cl.
USPC ..... 368/106; 368/112

(58) Field of Classification Search
USPC ..... 368/106–113, 37, 225
See application file for complete search history.

(56) References Cited

U.S. PATENT DOCUMENTS

| | | | | |
|---|---|---|---|---|
| 6,270,251 | B1 * | 8/2001 | Bron | 368/320 |
| 2004/0208085 | A1 * | 10/2004 | Watanabe et al. | 368/37 |
| 2004/0218473 | A1 | 11/2004 | Takahashi et al. | 368/37 |
| 2004/0264304 | A1 | 12/2004 | Furukawa et al. | 368/223 |
| 2008/0310257 | A1 * | 12/2008 | Perret et al. | 368/106 |
| 2009/0086583 | A1 * | 4/2009 | Wyssbrod | 368/106 |
| 2009/0147629 | A1 * | 6/2009 | Wyssbrod | 368/101 |
| 2010/0322038 | A1 * | 12/2010 | Habring et al. | 368/106 |

* cited by examiner

*Primary Examiner* — Vit W Miska
*Assistant Examiner* — Matthew Powell
(74) *Attorney, Agent, or Firm* — Adams & Wilks

(57) ABSTRACT

A chronograph timepiece includes heart cams, a start-stop button, a reset-to-zero button, and a start-stop lever and a reset-to zero instruction lever operated by the start-stop button and the reset-to-zero button, respectively, for undergoing rotation around a common rotation center. A hammer operating lever rotates in a first direction when the start-stop lever rotates and rotates in a second direction when the reset-to-zero instruction lever rotates. When the hammer operating lever rotates in the second direction, a hammer lever causes the heart cams to be reset to zero by bringing hammer portions of the hammer lever into engagement with respective ones of the heart cams. When the hammer operating lever rotates in the first direction, the hammer lever causes the hammer portions to be disengaged from the heart cams.

17 Claims, 18 Drawing Sheets

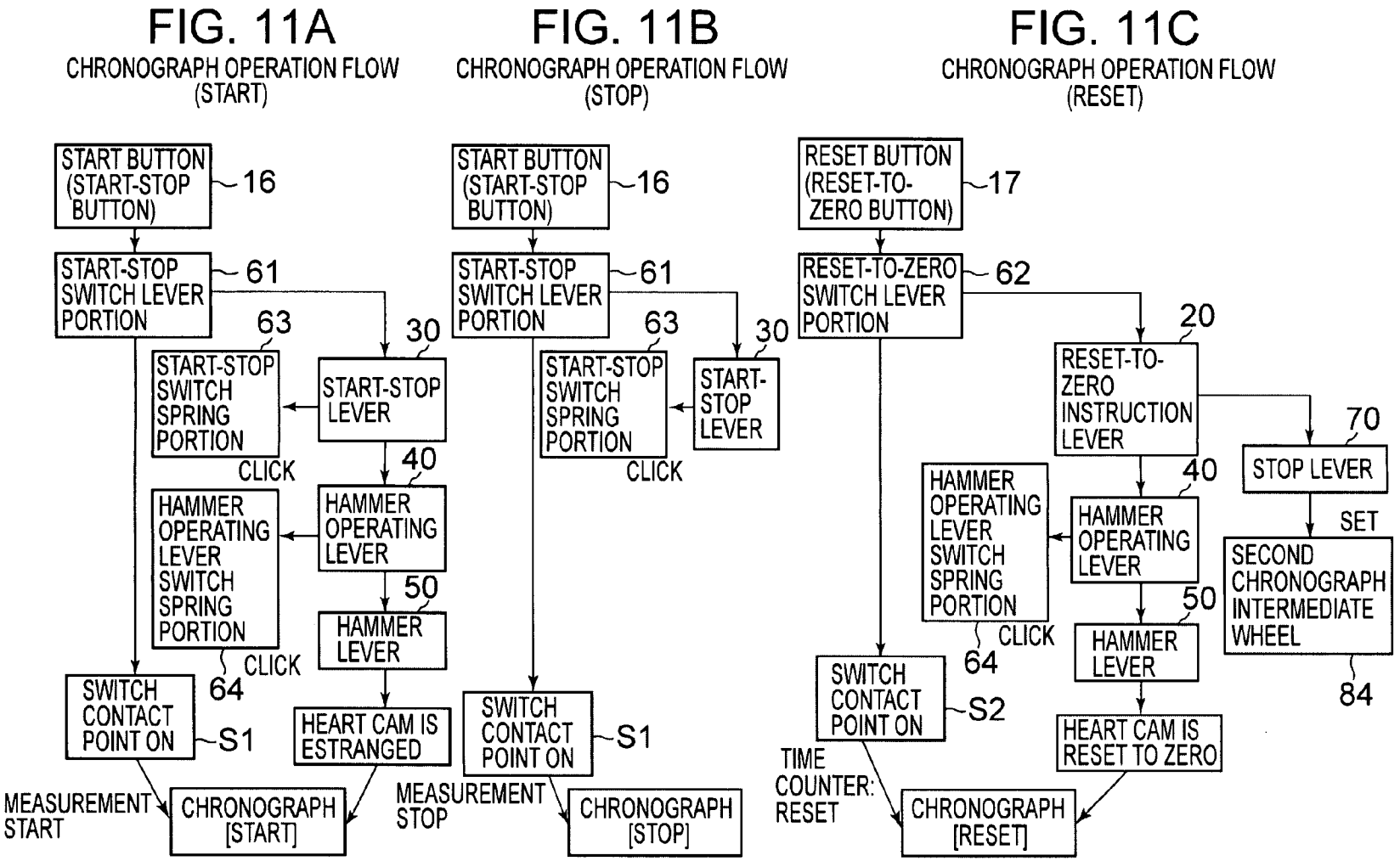
FIG. 11A
CHRONOGRAPH OPERATION FLOW (START)
START BUTTON (START-STOP BUTTON)
16
START-STOP SWITCH LEVER PORTION
61
START-STOP SWITCH SPRING PORTION
63
CLICK
START-STOP LEVER
30
HAMMER OPERATING LEVER
40
HAMMER OPERATING LEVER SWITCH SPRING PORTION
64
CLICK
HAMMER LEVER
50
HEART CAM IS ESTRANGED
SWITCH CONTACT POINT ON
S1
MEASUREMENT START
CHRONOGRAPH [START]
FIG. 11B
CHRONOGRAPH OPERATION FLOW (STOP)
START BUTTON (START-STOP BUTTON)
16
START-STOP SWITCH LEVER PORTION
61
START-STOP SWITCH SPRING PORTION
63
CLICK
START-STOP LEVER
30
SWITCH CONTACT POINT ON
S1
MEASUREMENT STOP
CHRONOGRAPH [STOP]
FIG. 11C
CHRONOGRAPH OPERATION FLOW (RESET)
RESET BUTTON (RESET-TO-ZERO BUTTON)
17
RESET-TO-ZERO SWITCH LEVER PORTION
62
RESET-TO-ZERO INSTRUCTION LEVER
20
STOP LEVER
70
SET
SECOND CHRONOGRAPH INTERMEDIATE WHEEL
84
HAMMER OPERATING LEVER
40
HAMMER OPERATING LEVER SWITCH SPRING PORTION
64
CLICK
HAMMER LEVER
50
HEART CAM IS RESET TO ZERO
SWITCH CONTACT POINT ON
S2
TIME COUNTER: RESET
CHRONOGRAPH [RESET]

CHRONOGRAPH TIMEPIECE

BACKGROUND OF THE INVENTION

1. Technical Field

The present invention relates to a chronograph timepiece, and more specifically to a, chronograph timepiece which is driven and controlled electrically and electronically and is suitable to be reset to zero mechanically. Also, in this specification, "the chronograph timepiece" refers to a timepiece having a chronograph function.

2. Related Art

In a type of chronograph timepiece which is mechanically driven and controlled and further mechanically reset to zero, there is one having a reset-to-zero mechanism where a position of a hammer lever itself is adjusted by a guide pin and is displaced such that three hammers are arranged with respect to corresponding heart cams (a self-alignment is performed), and the three hammers of the hammer lever cause the corresponding heart cams to be reset to zero (JP-A-2004-294277)

However, in the chronograph timepiece disclosed in JP-A-2004-294277, the reset-to-zero mechanism requires an operating cam provided with two kinds of gears such as a ratchet gear and a driving gear so as to perform each of start, stop, and reset actions, and further requires a plurality of levers or spring members related to each action so as to perform each via the operating cam. Thus, a number of components are necessary, thereby the structure is complex, the assemblability is poor, which leads to high costs.

In a type of a chronograph timepiece which is driven and controlled electrically and electronically, and is reset to zero mechanically, there has been proposed one in which a position or a displacement of a hammer lever having a plurality of hammers is controlled by a plurality of levers and spring members, without using the operating cam (for example, Japanese Utility Model Registration No. 2605696 or JP-A-2004-264036).

The reset-to-zero mechanism in Japanese Utility Model Registration No. 2605696 includes a hammer lever (the term in Japanese Utility Model Registration No. 2605696 is a "hammer operating lever") having a plurality of hammers, a first lever that can be engaged with a reset button in a rear anchor portion of a rear anchor side arm portion and has a forward end side arm portion with an interposed rotation center, and a second lever that is engaged with the forward end portion of the forward end side arm portion of the first lever in the rear anchor portion of the rear anchor side arm portion which is engaged with the hammer lever in the forward end of the forward end side arm portion and which is positioned at the rear anchor side of the rotation center and that can be engaged with a start/stop button in the vicinity of the rear anchor portion. Thereby, it has the minimal number of the levers.

However, in the reset-to-zero mechanism in Japanese Utility Model Registration No. 2605696, the first and second levers can perform only an action such as see-sawing, and thus, for example, when the start/stop button is pressed during the chronograph time measurement action and then a stopping action is performed, the start/stop button is not engaged with the second lever but just electrically connected to a switch contact point, thereby performing the stop action. Therefore, a user cannot reliably obtain a sense where the start/stop button is reliably pressed, it is easy to generate a defective operating or a defective instruction, and further the usability is poor.

On the other hand, in the reset-to-zero mechanism in JP-A-2004-264036, if the pressing action is completed using the start/stop button or the reset button a start-stop lever (the term in JP-A-2004-264036 is an "operating lever") or a hammer instruction lever group (the term in JP-A-2004-264036 is an "operating lever" and a "hammer operating lever") which have been displaced by the start/stop button or the reset button can return to original positions, and the sense of the start/stop button or the reset button being pushed down can be obtained when the start-stop lever or the hammer instruction lever is made to move to change positions from the original positions to the displaced positions. More specifically, in the reset-to-zero mechanism in JP-A-2004-264036, after the pressing of start/stop button or the reset button is completed, in order to cause the start-stop lever or the hammer instruction lever to return to the original position, the start-stop lever which is directly rotated by pressing the start/stop button, or the forward end side lever of the hammer instruction lever group which is directly rotated by pressing the reset button is fitted to and engaged with the hammer lever having a plurality of hammers with allowance, and thus the start-stop lever or the hammer instruction lever can return to the original position regardless of the position of the hammer lever.

However, in the case of the reset-to-zero mechanism of JP-A-2004-264036, since the start-stop lever or the hammer instruction lever (hammer operating lever) is fitted to and engaged with the hammer lever with allowance, it is difficult to prevent directions of a force applied to the hammer lever from being complicated, and a position of the hammer lever itself is adjusted and displaced. Therefore, it is difficult to employ the structure (the self-alignment structure) where the three hammers of the hammer lever cause the corresponding heart cams to be reset to zero.

In addition, in the reset-to-zero structure in JP-A-2004-264036, two levers (the terms in JP-A-2004-264036 are an "operating lever" and a "hammer operating lever") are necessary as the hammer instruction lever group, and they each respectively rotate around the separate rotation centers, and thus a taken-up region capable of performing the rotation of the lever increases.

Further, in a type of a chronograph timepiece where a hammer of a hammer lever moves roughly linearly and strikes a heart cam for the reset-to-zero, there is a problem in that when the hammer applies the reset-to-zero force to a tip of the heart cam towards a rotation center of the heart cam, it is difficult for the heart cam to be reset to zero.

In a chronograph timepiece where a hammer causes a heart cam to be reset to zero, if the hammer causes the heart cam to suddenly rotate, there is a concern that a display indication hand main body portion (a feather-shaped portion) and an installment portion (a skirt-shaped tube portion which is attached by being fitted to the chronograph stem) of a chronograph indication hand installed in a chronograph stem in which the heart cam is positioned is damaged. This concern is heightened as the chronograph indication hand becomes thinner and longer.

SUMMARY OF THE INVENTION

It is an aspect of the present application to provide a chronograph timepiece which, on the one hand, minimally takes up a region and which, on the other hand, enables a related lever to return to an original position when a chronograph action instruction button is not pressed.

It is another aspect of the present application to provide a chronograph timepiece which enables a hammer lever to perform a self-alignment action.

According to the present application, a chronograph timepiece includes a plurality of heart cams that are attached by being fitted to a plurality of chronograph stems; a start-stop button; a reset-to-zero button; a start-stop lever that rotates around a common rotation center positioned between the start-stop button and the reset-to-zero button in a circumferential direction of a timepiece main body, when the start-stop button is forced to be inserted; a reset-to-zero instruction lever that rotates around the common rotation center when the reset-to-zero button is forced to be inserted; a hammer operating lever of which one end rotates in a first direction when the start-stop lever rotates according to the forced insertion of the start-stop button, and of which the one end rotates in a second direction when the reset-to-zero instruction lever rotates according to the forced insertion of the reset-to-zero button; and a hammer lever that causes the plurality of heart cams to be reset to zero by bringing hammer portions of the hammer lever into engagement with respective ones of the heart cams when the other end of the hammer operating lever rotates in a reset-to-zero instruction direction according to the rotation in the second direction of the hammer operating lever, wherein the plurality of hammer portions are estranged (disengaged) from the corresponding heart cams or estranged (disengaged) states are maintained when the other end of the hammer operating lever rotates in a start-stop direction according to the rotation in the first direction of the hammer operating lever.

In this specification, "start-stop" means "start/stop," and the "start-stop button" is also referred to as a "start/stop button." Likewise, the "reset-to-zero button" is also referred to as a "reset button." In addition, a lever which is operated by pressing the start-stop button is referred to as a "start-stop lever," and a lever which is directly operated by pressing the reset-to-zero button is referred to as a "reset-to-zero instruction lever." In addition, the reset-to-zero instruction lever corresponds to one called a "hammer instruction lever A" or the like in the related art. A lever having a hammer which causes a heart cam to be reset to zero mechanically is referred to as a "hammer lever," and a lever which operates the hammer lever is referred to as a "hammer operation lever" (roughly corresponding to one called a "hammer operating lever B" or the like in the related art).

In the chronograph timepiece of the present application, since there is provided "a start-stop lever that rotates around a common rotation center positioned between the start-stop button and the reset-to-zero button in a circumferential direction of a timepiece main body, when the start-stop button is forced to be inserted, and a reset-to-zero instruction lever that rotates around the common rotation center when the reset-to-zero button is forced to be inserted," it is possible to suppress the number of the levers and a region taken up thereby which rotates when the start-stop button and the reset-to-zero button are pressed, to the minimum.

Also, in the chronograph timepiece of the present application, since there is provided "a hammer operating lever of which one end rotates in a first direction when the start-stop lever rotates according to the forced insertion of the start-stop button, and of which the one end rotates in a second direction when the reset-to-zero instruction lever rotates according to the forced insertion of the reset-to-zero button," both start-stop instructions due to the forced insertion of the start-stop button and the reset-to-zero instruction due to the forced button of the reset-to-zero button can be integrated into the rotation action or the rotation position of the hammer operating lever, and thus it is easy to control the hammer lever. Further, in the chronograph timepiece of the present application, since there is provided "a hammer lever that causes the plurality of heart cams to be reset to zero by corresponding hammer portions when the other end of the hammer operating lever rotates in the reset-to-zero instruction direction according to the rotation in the second direction of the hammer operating lever, wherein the plurality of hammer portions are estranged (disengaged) from the corresponding heart cams or the estranged (disengaged) states are maintained when the other end of the hammer operating lever rotates in a start-stop direction according to the rotation in the first direction of the hammer operating lever," it is possible to control the hammer lever in a desired form using the hammer operating lever, that is, control the reset-to-zero, and when the instruction button of the chronograph action (the start-stop button or the reset-to-zero button) is not pressed, a related lever can return to an original position, or the reset-to-zero control of the self-alignment type can be performed.

In the chronograph timepiece of the present invention, typically, the start-stop lever and the reset-to-zero instruction lever are in a relative position in a thickness direction of the timepiece, one lever of the start-stop lever and the reset-to-zero instruction lever is engaged with the one end of the thin plate shaped hammer operating lever in an output side end portion of the one lever, and the other lever of the start-stop lever and the reset-to-zero instruction lever is engaged with a pin shaped protruding portion which extends from the one end of the thin plate shaped hammer operating lever in a direction intersecting the thin plate surface of the hammer operating lever in an output side end portion of the other lever.

In that case, a main body of each lever is formed of a plate shaped body, and it is possible to suppress thickness, a taken-up region, and costs to the minimum.

In the chronograph timepiece of the present invention, typically, there is provided a battery which is a driving energy source, and a spring-like metal thin plate that provides a reference potential with respect to a voltage from the battery, wherein the metal thin plate includes a clicked sense providing means which provides a clicked sense regarding the forced insertions of the start-stop button and the reset-to-zero button.

In that case, as the chronograph timepiece performing the electric and electronic driving and the mechanical reset-to-zero, it is possible to obtain the presence of a clicked sense (temperate sense). The reason why the clicked sense providing means is separately formed is that since the hammer operating lever is engaged with the start-stop lever and the reset-to-zero instruction lever which are operated by the forced insertions of the start-stop button and the reset-to-zero button, when the forced insertion actions of the start-stop button and the reset-to-zero button are completed and the buttons return to the original positions, the start-stop lever and the reset-to-zero instruction lever can also return to original positions.

In the chronograph timepiece of the present invention, typically, the clicked sense providing means includes a spring portion used to provide sense of the start-stop button being pressed and having a shoulder portion; and a pin-shaped engagement portion into which the start-stop lever deviates from the shoulder portion of the spring portion used to provide the sense of the start-stop button being pressed and is forced to be inserted, when the start-stop lever rotates according to the forced insertion of the start-stop button.

In that case, it is possible to give a clicked sense (temperate sense) to an operator when the start-stop button is pressed. This is useful, particularly when a stop action or a restart action using the start-stop button is performed.

In the chronograph timepiece of the present invention, typically, the start-stop lever rotates and is locked in a locking portion positioned at an outer periphery of a support substrate.

In that case, the start-stop button which is biased to an initial position by the shoulder portion of the spring portion used to provide a pressing sense of the start-stop button can be reliably locked in the initial position. In addition, the support substrate is formed of, for example, a main plate, but may be formed of any other standing support body such as a chronograph lower plate.

In the chronograph timepiece of the present invention, typically, the clicked sense providing means includes a spring portion used to set a position of the hammer operating lever and having a convex portion, wherein the hammer operating lever includes a pin-shaped protrusion which is positioned at one side of the convex portion of the spring portion used to set a position of the hammer operating lever in a start-stop control position where the hammer portions of the hammer lever are estranged (disengaged) from the corresponding heart cams, and which is positioned at the other side of the convex portion of the spring portion used to set a position of the hammer operating lever in a reset-to-zero operating control position where the hammer portions of the hammer lever come into contact with (disengaged) the corresponding heart cams, and wherein when the pin-shaped protrusion overcomes the convex portion of the spring portion used to set a position of the hammer operating lever, the spring portion used to set a position of the hammer operating lever is elastically deformed.

In that case, it is possible to obtain both the positioning and the clicked sense (temperate sense). In other words, depending on whether the pin-shaped protrusion of the hammer operating lever is positioned at the one side of the convex portion of the spring portion used to set a position of the hammer operating lever or at the other side thereof, the hammer operating lever is selectively placed at the start-stop control position or the reset-to-zero operation control position and thus the opening of the heart cams and the reset-to-zero are controlled by the hammer lever. Further, when the hammer operating lever is displaced from the start-stop control position to the reset-to-zero operation control position by overcoming the convex portion from the one side of the convex portion of the spring portion used to set a position of the hammer operating lever to the other side thereof, a clicked sense due to the pressing of the reset-to-zero button is given to an operator. When the hammer operating lever is displaced from the reset-to-zero operation control position to the start-stop control position by overcoming the convex portion from the other side of the convex portion of the spring portion used to set a position of the hammer operating lever to the one side thereof, a clicked sense due to the pressing of the start-stop button for instructing chronograph measurement start can be also given to an operator.

In the chronograph timepiece of the present invention, typically, in a case where the pin-shaped protrusion of the hammer operating lever is positioned at the other side of the convex portion of the spring portion used to set a position of the hammer operating lever in order to maintain the hammer portions of the hammer lever at the reset-to-zero operating control position for contact with the corresponding heart cams, when the reset-to-zero button is forced to be inserted to the maximum and the reset-to-zero instruction lever rotates to the maximum, there is a gap between an output side end portion of the reset-to-zero instruction lever and an input side end portion thereof corresponding to the hammer operating lever.

In that case, even when an impact is mistakenly applied to the reset-to-zero button due to dropping or being stricken by external objects and thus the reset-to-zero button is rapidly forced to be inserted, there is no concern that a great impact is transmitted to the hammer operating lever via the reset-to-zero button, and it is possible to suppress damage of the related levers inflicted by the impact to the minimum.

In the chronograph timepiece of the present invention, typically, in a case where the pin-shaped protrusion of the hammer operating lever is positioned at the one side of the convex portion of the spring portion used to set a position of the hammer operating lever in order to maintain the hammer portions of the hammer lever at the start-stop control position for being estranged (disengaged) from the corresponding heart cams, when the start-stop button is forced to be inserted to the maximum and the start-stop lever rotates to the maximum, there is a gap between an output side end portion of the start-stop lever and an input side end portion thereof corresponding to the hammer operating lever.

In that case, even when an impact is mistakenly applied to the start-stop button due to dropping or being stricken by external objects and thus the start-stop button is rapidly forced to be inserted, there is no concern that a great impact is transmitted to the hammer operating lever via the start-stop lever, and it is possible to suppress damage of the related levers inflicted by the impact to the minimum.

In the chronograph timepiece of the present invention, typically, the start-stop lever, the reset-to-zero instruction lever, the hammer operating lever, and the hammer lever are arranged between a chronograph lower plate and a switch spring, when seen from the thickness direction of the timepiece.

In that case, the chronograph mechanism can be built in general electronic timepieces in a compact manner.

In the chronograph timepiece of the present invention, typically, there is provided a stop lever that rotates according to rotation of the reset-to-zero instruction lever when the reset-to-zero button is pressed and that sets a chronograph train wheel.

In that case, at the time of the reset-to-zero instruction, the reset-to-zero action can be performed without influencing a chronograph hand operation motor. The setting for the chronograph train wheel by the stop lever is performed via the reset-to-zero instruction lever according to the rotation of the reset-to-zero instruction button, whereas the mechanical reset-to-zero of the heart cams is performed via the hammer operating lever and the hammer lever from the reset-to-zero instruction lever. Thus, the setting for the chronograph train wheel by the stop lever can be reliably performed earlier than the mechanical reset-to-zero of the heart cams by the hammers.

In the chronograph timepiece of the present invention, typically, the stop lever sets a second chronograph wheel intermediate wheel which transmits rotation of a motor to a second chronograph wheel, and the second chronograph wheel includes a slip mechanism.

In that case, there is no concern that a rotor of the motor used to drive the chronograph train wheel is forced to be turned during the reset-to-zero action (concern that the rotor is out of phase), and from this viewpoint, there is no concern that an error occurs. In addition, if desired, the wheel itself of the second chronograph wheel may be directly set, and, if necessary, other chronograph wheels may be set.

In the chronograph timepiece of the present invention, typically, a position of the hammer lever is determined in a self-alignment type in such a manner that a force which is applied to the hammer lever from the hammer operating lever is balanced with a force which is applied to the plurality of hammer portions of the hammer lever from the corresponding heart cams, and performs the reset-to-zero action.

In that case, the mechanical reset-to-zero can be reliably performed. The reason why such a self-alignment type positioning mechanism can be built in is that the start-stop lever and the reset-to-zero instruction lever are engaged with the hammer operating lever so as to reversely rotate the hammer operating lever, and the hammer operating lever causes the hammer lever to perform the self-alignment action, along with the heart cams.

Here, typically, the self-alignment action is realized as follows. An engagement portion (typically, an elongated hole) of the hammer lever is engaged with an engaged portion (typically, the pin-shaped protrusion) such that a position or direction of the hammer lever is deviated and thereby a force to exactly cause a reaction with respect to an external force applied to the hammer lever from the hammer operating lever is applied to the hammer portion corresponding to the hammer lever from a plurality of heart cams. The number of the hammers is typically three (a chronograph hour hammer, a chronograph minute hammer, and a chronograph second hammer), but, if necessary, may be two.

In the chronograph timepiece of the present invention, typically, the hammer lever includes a force input portion which is applied with a force from the hammer operating lever; the chronograph timepiece further includes a displacement guide mechanism which guides a displacement of the hammer lever when the hammer lever is applied with a force from the hammer operating lever via the force input portion; the displacement guide mechanism includes two guide pins and guide elongated hole shaped portions to which the respective guide pins are fitted; and one guide elongated hole shaped portion of the two guide elongated hole shaped portions includes a concave portion which allows the guide pin to be displaced in a direction intersecting a longitudinal direction of the one guide elongated hole shaped portion, at a lateral surface in the longitudinal direction of the one guide elongated hole shaped portion in a region where the corresponding guide pin is positioned inside the one guide hole shaped portion, when the hammer portions of the hammer lever come into contact with tips of the corresponding heart cams.

In that case, since there is provided "one guide elongated hole shaped portion of the two guide elongated hole shaped portions that includes a concave portion which allows the guide pin to be displaced in a direction intersecting a longitudinal direction of the one guide elongated hole shaped portion, at a lateral surface in the longitudinal direction of the one guide elongated hole shaped portion in a region where the corresponding guide pin is positioned inside the one guide elongated hole shaped portion, when the hammer portions of the hammer lever come into contact with tips of the corresponding heart cams," in a state where "the hammer portions of the hammer lever come into contact with tips of the corresponding heart cams," even when forces exactly towards the rotation centers of the heart cams are applied to the heart cams from the hammer portions and thereby the heart cams enter a strut state where they cannot rotate in any direction, torque is applied to the hammer lever around the one guide pin due to the force (a counterforce, that is, a reaction) applied to the corresponding hammer portions of the hammer lever from the tips of the heart cams and the force applied to the force input portion of the hammer lever from the hammer operating lever. Further, since the displacement of the guide pin is allowed inside the concave portion of the lateral surface of the guide elongated hole shaped portion, the hammer lever fluctuates due to the torque, and, by this fluctuation, the guide pin enters the concave portion of the lateral surface of the guide elongated hole shaped portion. As a result, depending on the shapes of the heart cam contact surfaces of the hammer portions, displacement directions of the hammer portions (a longitudinal direction of the guide elongated hole shaped portion), and relative directions of the heart cam contact surfaces of the hammer portions with respect to the heart cams, and depending on the forced insertion, the heart cam contact surfaces of the hammer portions deviate from the tips of the heart cams (any one side of the tip), and the hammer portions come into contact with the surface portions in the vicinity of the tips of the heart cams. Thereby, it is possible to reliably perform a general reset-to-zero action where the hammer portions escape from the strut state to cause the heart cams to be turned.

In addition, when a corresponding hammer portion comes into contact with one heart cam of the plural heart cams, usually, since corresponding hammer portions have not come into contact with the other heart cams of the plural heart cams yet, the rotation or the fluctuation of the hammer lever is enough if the force with which the hammer lever is applied from the force input portion and the force with which the hammer portion coming into contact with the tip of the heart cam is applied from the heart cam. In other words, even if the heart cams are provided in plurality, a possibility that the tips of two or more heart cams and the corresponding hammer portions exactly come into contact with each other is very low. However, even when the tips of two or more heart cams and the corresponding hammer portions exactly come into contact with each other, the hammer lever fluctuates due to a sum total of torque applied to the hammer lever and the guide pin enters the concave portion, thereby escaping from the strut state at once in the same manner. In a case where the sizes of the heart cams are different from each other, the concave portion may be formed at other places, or a single long (large width) concave portion may be formed.

The heart cam has typically a reflection symmetry shape with respect to a virtual line connecting the tip and the rotation center. However, if desired, the heart cam may have an asymmetrical shape, and when the hammer comes into contact with the vicinity of the tip of the heart cam, the reset-to-zero torque applied to the heart cam may become larger.

The plural hammer portions are typically positioned at places different from the guide elongated hole shaped portion, and when the strut state comes, since the a direction of a torque applied to the hammer lever may vary, the concave portions are typically provided in both the lateral surfaces of the guide elongated hole shaped portion. However, in a case where a difference in a frequency at which the strut state occurs is likely to be great, the concave portion may be provided only in one side.

The chronograph timepiece of the present invention, typically, is configured to perform the self-alignment type action described above; however, the strut state occurs in cases other than the self-alignment type, and thus the chronograph timepiece may not be of the self-alignment type.

In the self-alignment type, typically, the heart cams of the chronograph timepiece are formed to have the same size and shape, and when the strut state occurs between each of the heart cams and the corresponding hammer portion, each heart cam is arranged and a direction of the contact surface of each hammer portion is set such that a position taken by the hammer lever becomes the same with respect to all the heart cams and the hammer portions. In that case, the number of the concave portions of the respective lateral surfaces of the guide elongated hole shaped portion may be actually one. However, depending on the sizes or relative positions of the plural heart cams or directions of the contact surfaces of the hammer portions, the concave portion of at least one surface of the guide elongated hole shaped portion may be formed at plural places. Further, if desired, the concave portions at the plural places may be connected singly.

In the chronograph timepiece of the present invention, typically, each of the guide pins is provided in the support substrate of the timepiece in the protruding manner, and the each of the guide elongated hole shaped portions is formed in the hammer lever.

In that case, the guide and the fluctuation of the hammer lever are reliably and easily performed. However, if desired, two guide pins may be provided in the hammer lever in a protruding manner, and a corresponding guide elongated hole shaped portion may be formed on a surface of the support substrate facing protruding ends of the pins.

In the chronograph timepiece of the present invention, typically, the concave portion is formed in one surface of the one guide elongated hole shaped portion. However, if desired, as described above, the concave portion may be formed in both lateral surfaces of each guide elongated hole shaped portion.

In the chronograph timepiece of the present invention, typically, the guide elongated hole shaped portions of the displacement guide mechanism includes a braking convex portion which protrudes towards a center of the guide elongated hole shaped portion from the lateral surface of the guide elongated hole shaped portion in order to hinder the guide pins fitted to the guide elongated hole shaped portion from being relatively displaced in the longitudinal direction of the guide elongated hole shaped portion such that a braking force is applied to the hammer lever, when the hammer lever approaches a reset-to-zero position where contact surface portions of the hammer portions of the hammer lever come into contact with minimal diameter contact portions of the corresponding heart cams.

In that case, when the guide pin moves relatively to the guide elongated hole shaped portion inside the guide elongated hole shaped portion by the movement of the hammer lever during the reset-to-zero action, the guide pin collides with the braking convex portion which protrudes from the lateral surface of the guide elongated hole shaped portion and reduces its speed. Therefore, there is little concern that the hammer portion of the hammer lever of the guide pin inflicts an excessive impact on the heart cam, and thus a display indication hand main body of chronograph hands such as a second chronograph hand, a skirt-shaped tube portion installed in a chronograph stem of the display indication hand main body, or the like is damaged.

Further, when the guide pin comes into contact with the braking convex portion, the guide elongated hole shaped portion has a concave portion which allows a direction change of the guide pin in a location roughly facing the braking convex portion in the lateral surface opposite to the lateral surface in which the braking convex portion is positioned, such that the guide pin can be displaced transversely (a direction intersecting the longitudinal direction of the guide elongated hole shaped portion) inside the guide elongated hole shaped portion.

Also, typically, there is provided another braking convex portion with which the guide pin changes its direction by contact with the initial braking convex portion collides. In this case, it is possible to reliably perform the braking using the braking convex portions.

BRIEF DESCRIPTION OF THE DRAWINGS

FIGS. 11A, 11B and 11C are block diagrams illustrating a schematic action of the chronograph timepiece according to a preferable embodiment of the present invention, in which FIG. 11A is a block diagram illustrating a schematic flow when a chronograph action starts, and FIG. 11B is a block diagram illustrating a schematic flow when the chronograph action stops, and FIG. 11C is a block diagram illustrating a schematic flow when the chronograph action is reset;

DETAILED DESCRIPTION OF THE INVENTION

Figure 1:
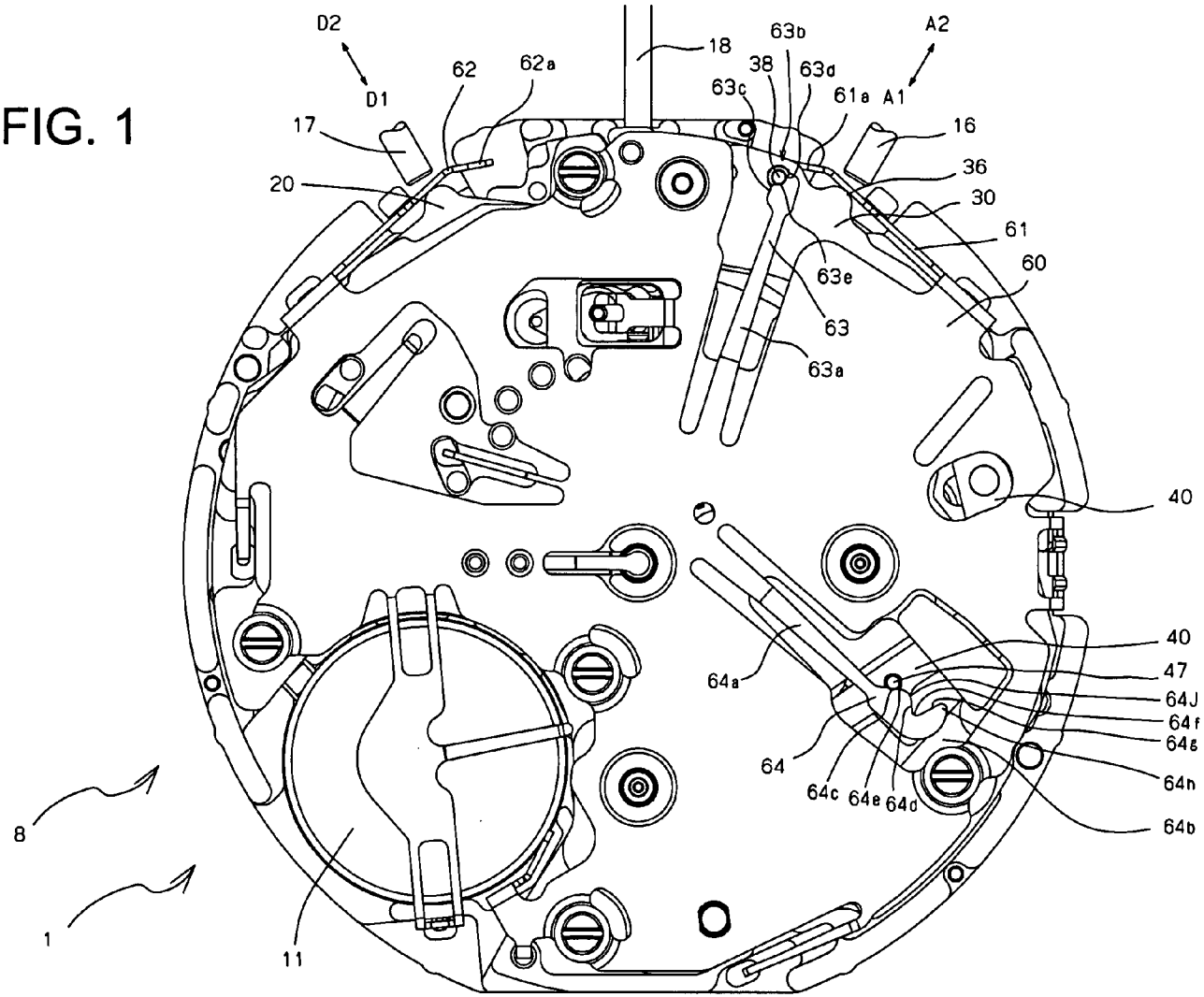
FIG. 1 is a plan view, when seen from the case back side, of a main body of a chronograph timepiece according to a preferable embodiment of the present invention shown in FIG. 9.

A preferable embodiment of the present invention will be described based on a preferable embodiment shown in the accompanying drawings.

Embodiment 1

A chronograph timepiece 1 according to a preferable embodiment of the present invention is provided with, for example, as can be seen from FIGS. 1 to 3 and FIGS. 9 and 10, a normal hand operation motor 12 and a chronograph hand operation motor 13 using a battery 11 as a power supply, and is driven electrically and electronically through respective related train wheels, that is, a normal hand operation train wheel 14 and a chronograph train wheel 15 by the motors 12 and 13. The reference numeral 19 denotes a timepiece stem, and the reference numeral 18 denotes a winding stem. In addition, in this specification, the chronograph timepiece 1 refers to a timepiece having a chronograph function.

Figure 3:
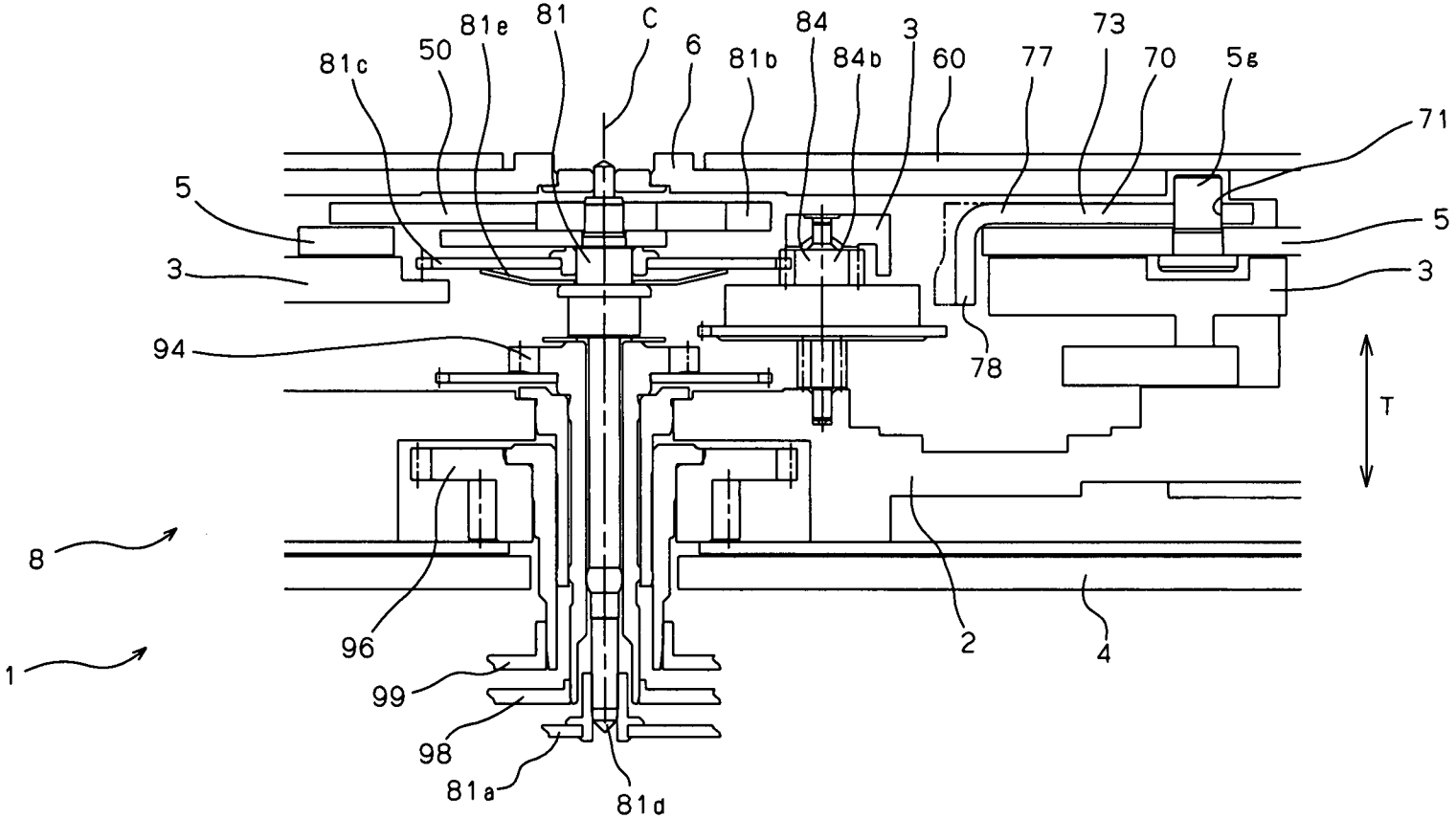
FIG. 3 is a longitudinally sectional view of the vicinity of the center of the chronograph timepiece shown in FIG. 1.
Figure 9:
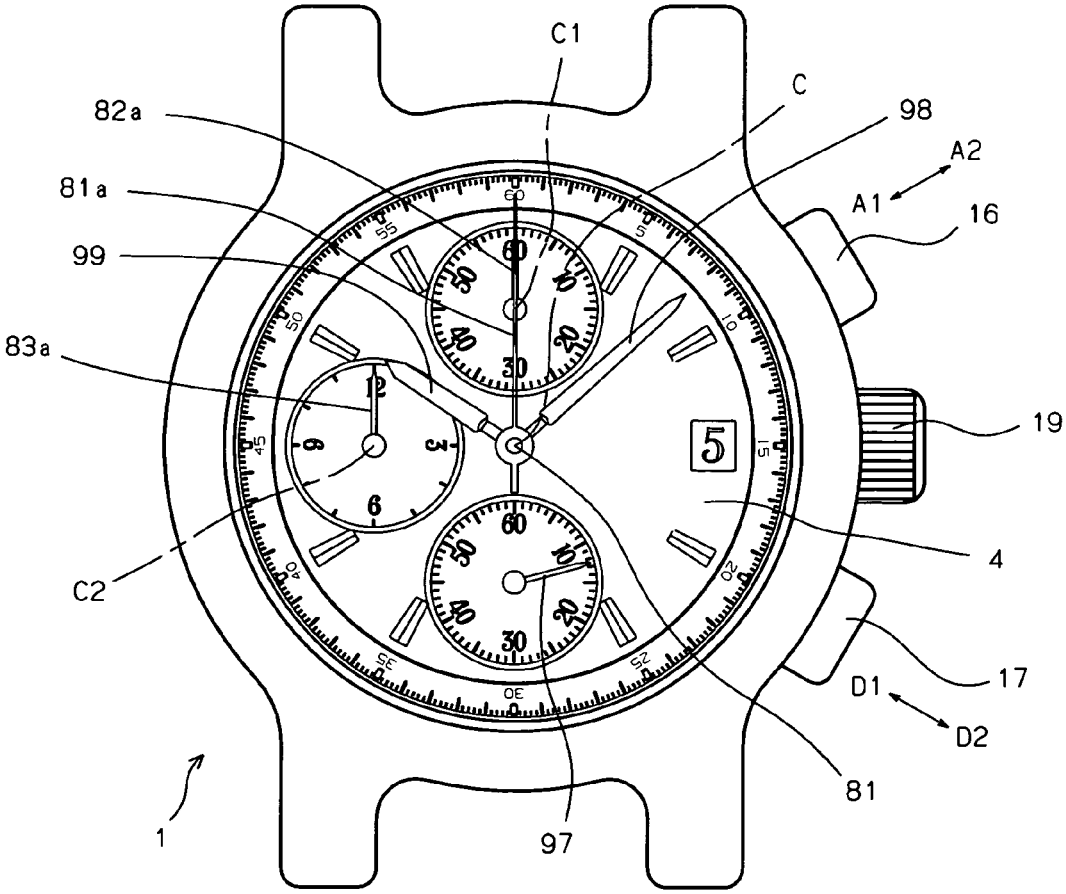
FIG. 9 is a plan view illustrating an exterior of the chronograph timepiece according to a preferable embodiment of the present invention.
Figure 10:
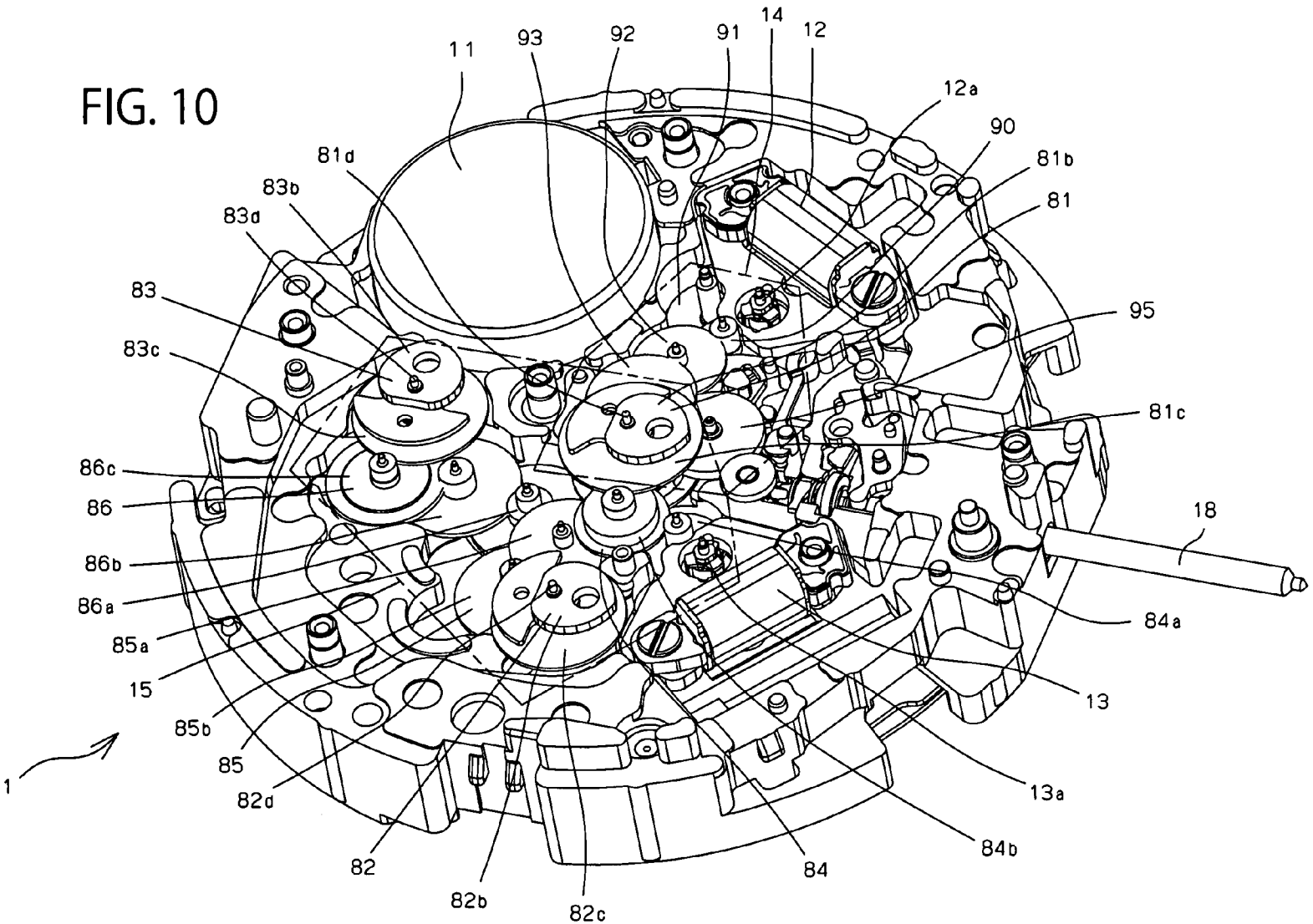
FIG. 10 is a perspective view illustrating train wheels for normal operation and train wheels for chronograph of the chronograph timepiece shown in FIG. 1.

A main body or a movement 8 of the chronograph timepiece 1, as can be seen from FIG. 3, FIG. 9, and FIG. 10, includes a second indicator 91 which rotates through from a rotor 12*a* of the normal hand operation motor 12 to a fifth wheel and pinion 90, a minute indicator 94 which rotates through from the fifth wheel and pinion 90 to a fourth wheel and pinion 92 and the a third wheel and pinion 93, and an hour indicator 96 which rotates from the minute indicator 94 to a minute wheel 95. The second indicator 91, the minute indicator 94, and the hour indicator 97 are respectively installed with a secondhand 97, a minute hand 98, and an hour hand 99. As can be seen from the sectional view of FIG. 3 and the exterior diagram of FIG. 9, the minute hand 98 and the hour hand 99 rotate around the central axis line C of the chronograph timepiece 1, and the second hand 97 has a form of a small second hand which rotates spaced apart from the central axis line C. Most of the wheels 12*a*, 90, 91, 92 and 93 in the normal operation train wheel 14 are supported between a main plate 2 and a train wheel bridge 3, and the time indicator 96 or the like is supported by a dial 4 side of the main plate 2.

The chronograph timepiece 1, as shown in the sectional view of FIG. 3, the exterior diagram of FIG. 9, and the perspective view of FIG. 10, includes a chronograph secondhand 81*a* which is installed in a second chronograph stem 81*d* rotating around the central axis line C, a chronograph minute hand 82*a* which is installed in a minute chronograph stem 82*d* rotating around the rotation center C1 positioned at twelve o'clock, and a chronograph hour hand 83*a* which is installed in an hour chronograph stem 83*d* rotating around the rotation center C2 positioned at nine o'clock. In addition, as can be seen from FIG. 10 or the like, heart cams 81*b*, 82*b* and 83*b* are fitted and coupled to the chronograph stems 81*d*, 82*d* and 83*d*, respectively.

As can be seen from FIG. 3, a second chronograph wheel 81*c* is fit into the second chronograph stem 81*d* to slidably rotate via a pressing force spring 81*e*. In the same manner, as shown in FIG. 10, a minute chronograph wheel 82*c* is fit into the minute chronograph stem 82*d* to slidably rotate via a pressing force spring (not shown), and an hour chronograph wheel 83*c* is fit into the second chronograph stem 83*d* to slidably rotate via a pressing force spring (not shown). Here, the second chronograph stem 81*d*, the second heart cam 81*b*, the second chronograph wheel 81*c*, the pressing spring 81*e*, and the like constitute a second chronograph wheel 81. The minute chronograph stem 82*d*, the minute heart cam 82*b*, the minute chronograph wheel 82*c*, the pressing spring (not shown), and the like constitute a minute chronograph wheel 82, and the hour chronograph stem 83*d*, the hour heart cam 83*b*, the hour chronograph wheel 83*c*, the pressing spring (not shown), and the like constitute an hour chronograph wheel 83.

The chronograph train wheel 15 is schematically disposed between the main plate 2 and the train wheel bridge 3. The second chronograph wheel 81, the minute chronograph wheel 82, the hour chronograph wheel 83, and chronograph related levers which will be described later in detail face toward the thickness direction T of the chronograph timepiece 1, and are mainly disposed between a chronograph lower plate 5 and a chronograph bridge 6. In the case of the back side of the chronograph bridge 6, there is a disposition of a battery connection (+) 60 which is formed of a spring-like metal thin film plate which applies a reference potential.

The chronograph train wheel 15 includes the second chronograph wheel 81 which rotates due to the second chronograph wheel 81*c* through from the rotor 13*a* of the chronograph hand operation motor 13 to second chronograph intermediate wheels 84 (in this example, including a second chronograph first and second intermediate wheels 84*a* and 84*b*), the minute chronograph wheel 82 which rotates due to the minute chronograph wheel 82*c* through from the second chronograph second intermediate wheel 84*b* to minute chronograph intermediate wheels 85 (in this example, including minute chronograph first and second intermediate wheels 85*a* and 85*b*), and the hour chronograph wheel 83 which rotates due to the hour chronograph wheel 83*c* through from the minute chronograph first intermediate wheel 85*a* to hour chronograph intermediate wheels 86 (in this example, including hour chronograph first, second and third intermediate wheels 86*a*, 86*b* and 86*c*).

A mechanical chronograph mechanism 7 includes, in addition to a start-stop button 16 and a reset (reset-to-zero) button 17, a reset-to-zero instruction lever 20, a start-stop lever 30, a hammer operating lever 40, and a hammer lever 50, and a stop lever 70.

The battery connection (+) 60 is a conductor which applies a reference potential to an electric circuit block or the like of the movement 8, is constituted by one having a mechanical spring property, that is, a metal thin plate having the spring property, and includes a start-stop switch lever portion 61, a reset-to-zero switch lever portion 62, a start-stop switch spring portion 63, and a hammer operating lever switch spring portion 64.

Figure 4:
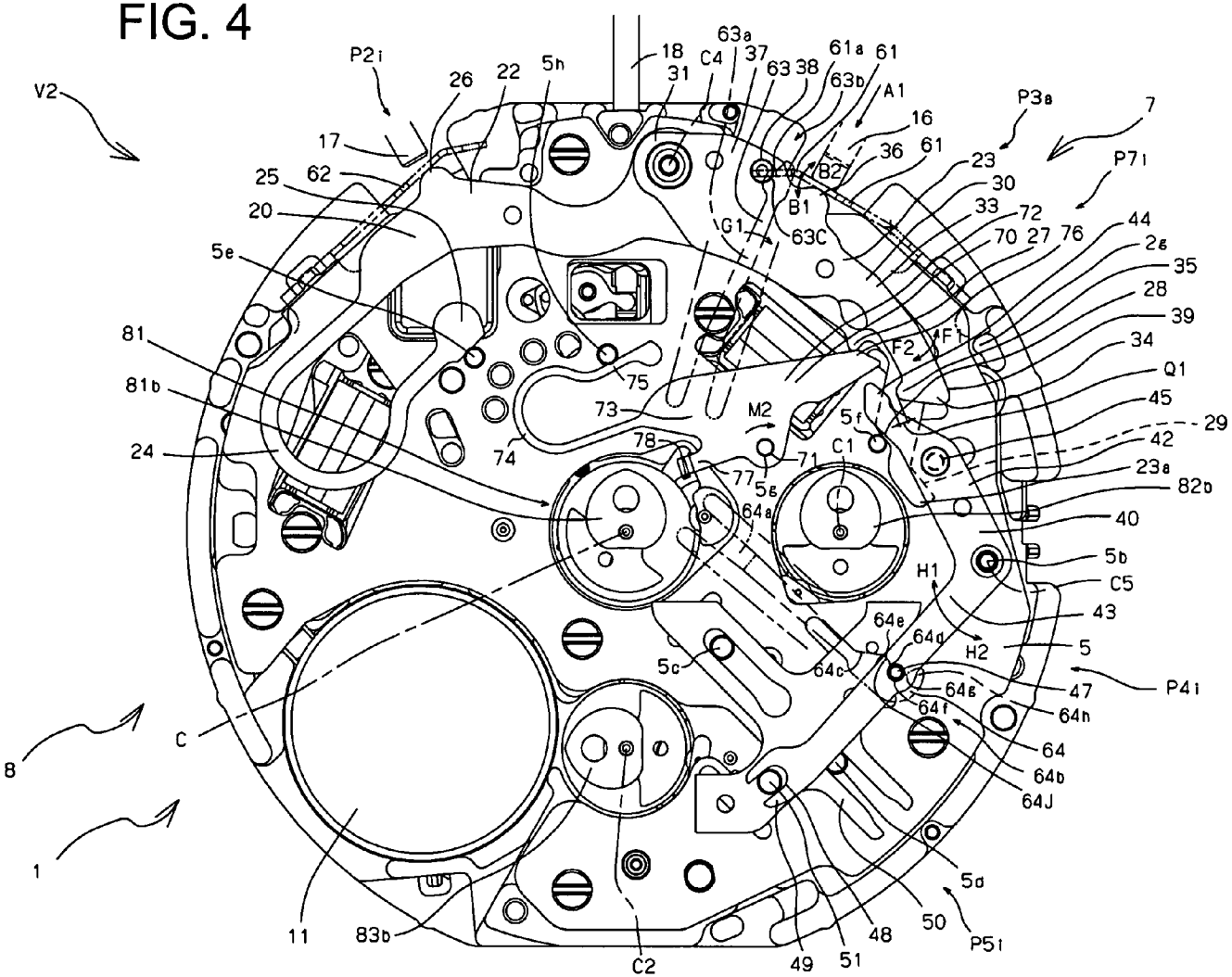
FIG. 4 is a plan view, which is the same as FIG. 2, illustrating a state of instructing starting of the chronograph by pressing a start-stop button (start/stop button) of the chronograph timepiece shown in FIG. 1.
Figure 6:
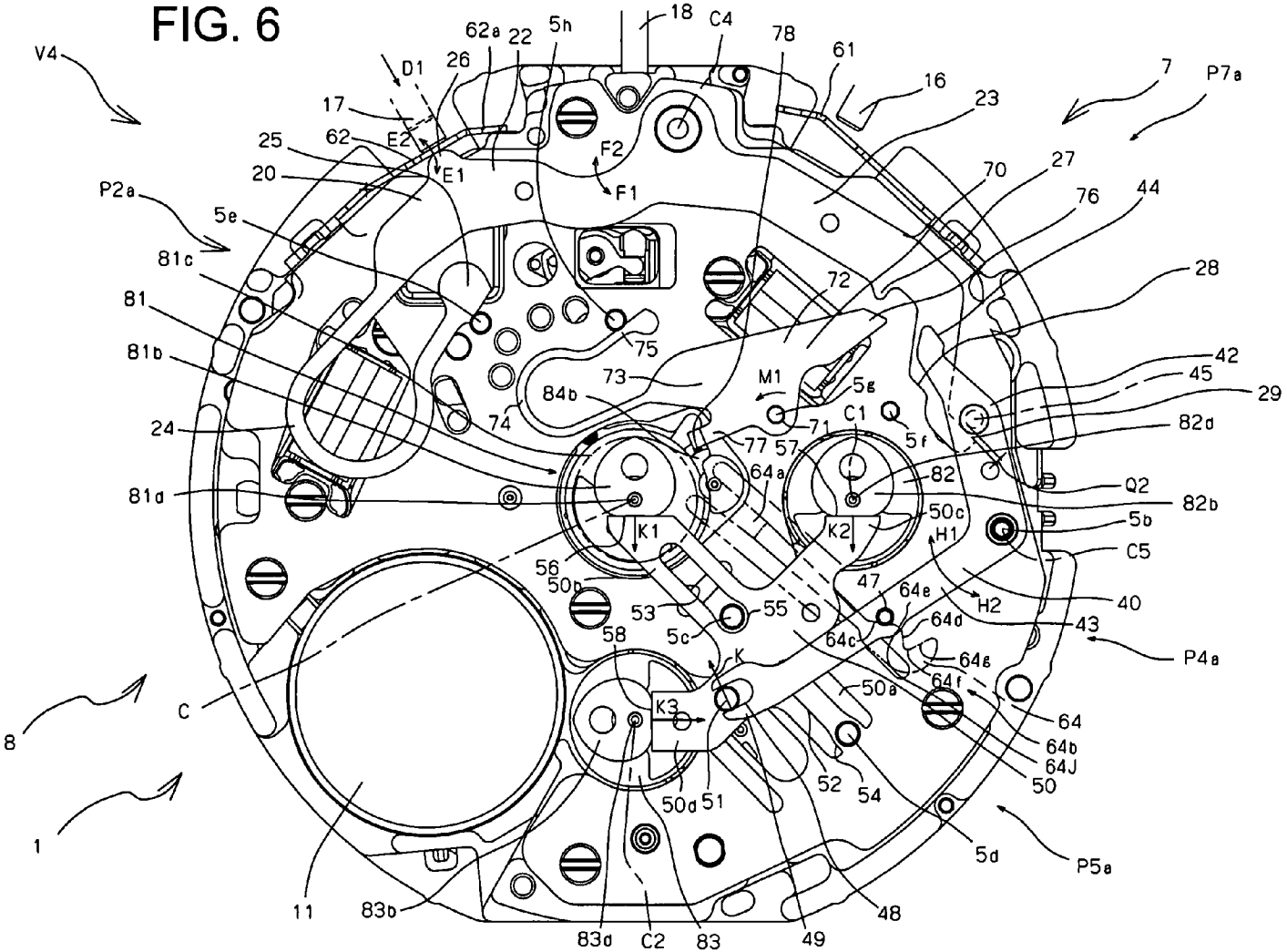
FIG. 6 is a plan view, which is the same as FIG. 2, illustrating a state of instructing mechanical reset-to-zero chronograph by pressing a reset-to-zero button (reset button) of the chronograph timepiece shown in FIG. 1.

The start-stop button 16 can advance and regress in directions A1 and A2, and, as shown in FIG. 4, when it is forced to be inserted in the direction A1, causes the start-stop switch lever portion 61 to fluctuate in the direction B1, thereby pressing a forward end portion 61*a* of the start-stop switch lever portion 61 to a contact point of a lateral surface of a circuit board (not shown) so as to generate an electric start-stop signal S1. In the same manner, the reset-to-zero button 17 can advance and regress in the directions D1 and D2, and, as shown in FIG. 6, when it is forced to be inserted in the direction D1, causes the reset-to-zero switch lever portion 62 to fluctuate in the direction E1, thereby pressing a forward end portion 62*a* of the reset-to-zero switch lever portion 62 to a contact point of the lateral surface of the electric board (not shown) so as to generate an electric reset-to-zero signal S2.

Figure 8:
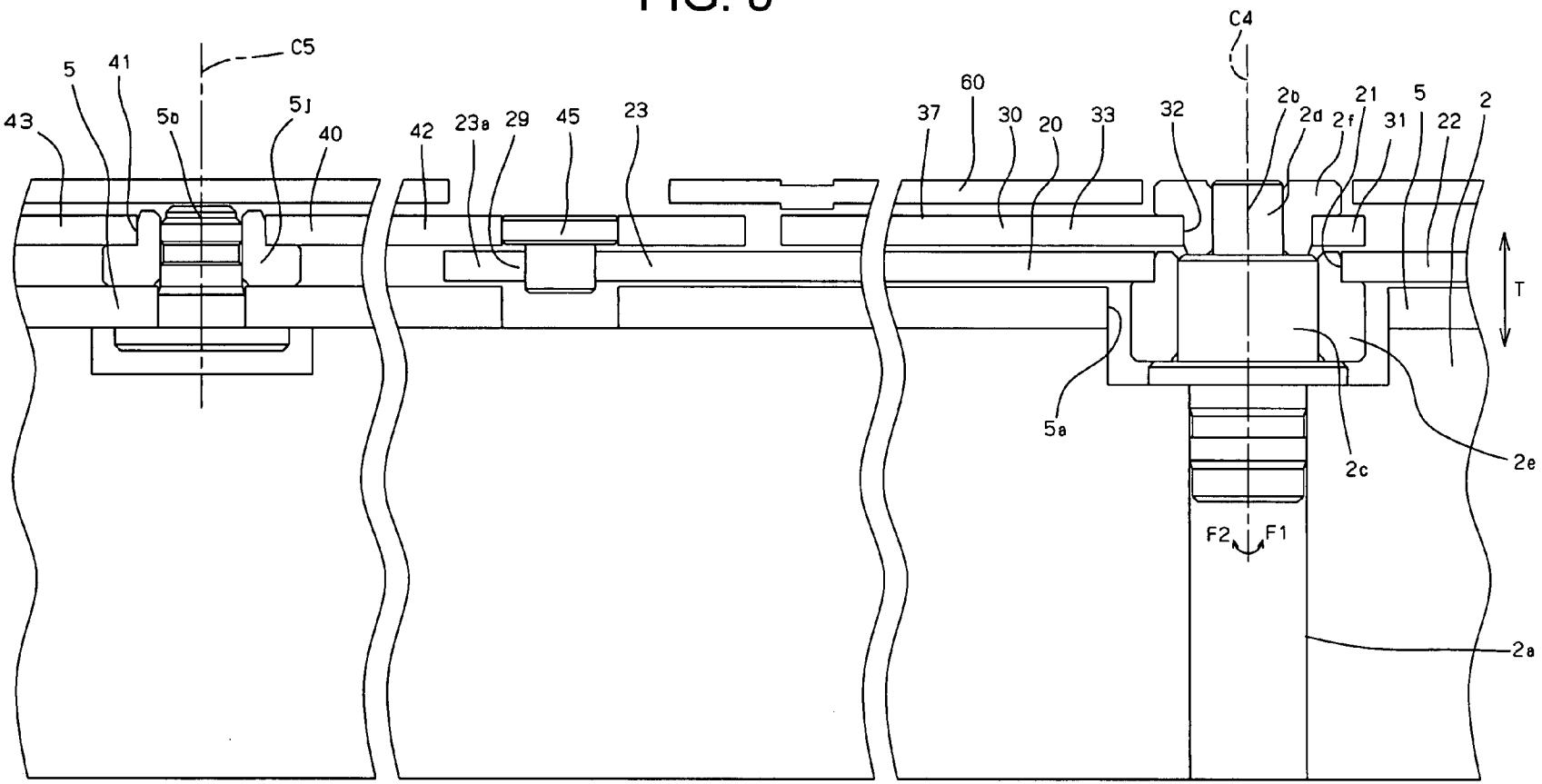
FIG. 8 is a sectional view of a portion of parts related to the mechanical chronograph mechanism of the chronograph timepiece shown in FIG. 1.

The main plate 2 is provided with a hole portion 2*a* (FIG. 8) in a region between the regions where the start-stop button 16 and the reset-to-zero button 17 in the circumferential direction of the chronograph timepiece 1, and a rotation center pin 2*b* is screwed in the hole 2*a*. The rotation center pin 2*b*, as shown in FIG. 8, penetrates a through-hole 5*a* of the chronograph lower plate 5 which is positioned to be arranged with the hole portion 2*a* and includes a reset-to-zero instruction lever fitting portion 2*c* and a start-stop lever fitting portion 2*d* in the longitudinal direction (the thickness direction T of the chronograph timepiece 1). The reset-to-zero instruction lever fitting portion 2*c* of the rotation center pin 2*b* supports the reset-to-zero instruction lever 20 so as to slidably rotate around the central axis line C4 in the directions F1 and F2 via a ring-shaped axle bridge portion 2*e*. Likewise, the start-stop lever fitting portion 2*d* of the rotation center pin 2*b* supports the start-stop lever 30 so as to slidably rotate around the common central axis line C4 in the directions F1 and F2 via the ring-shaped axle bridge portion 2*f*.

Figure 2:
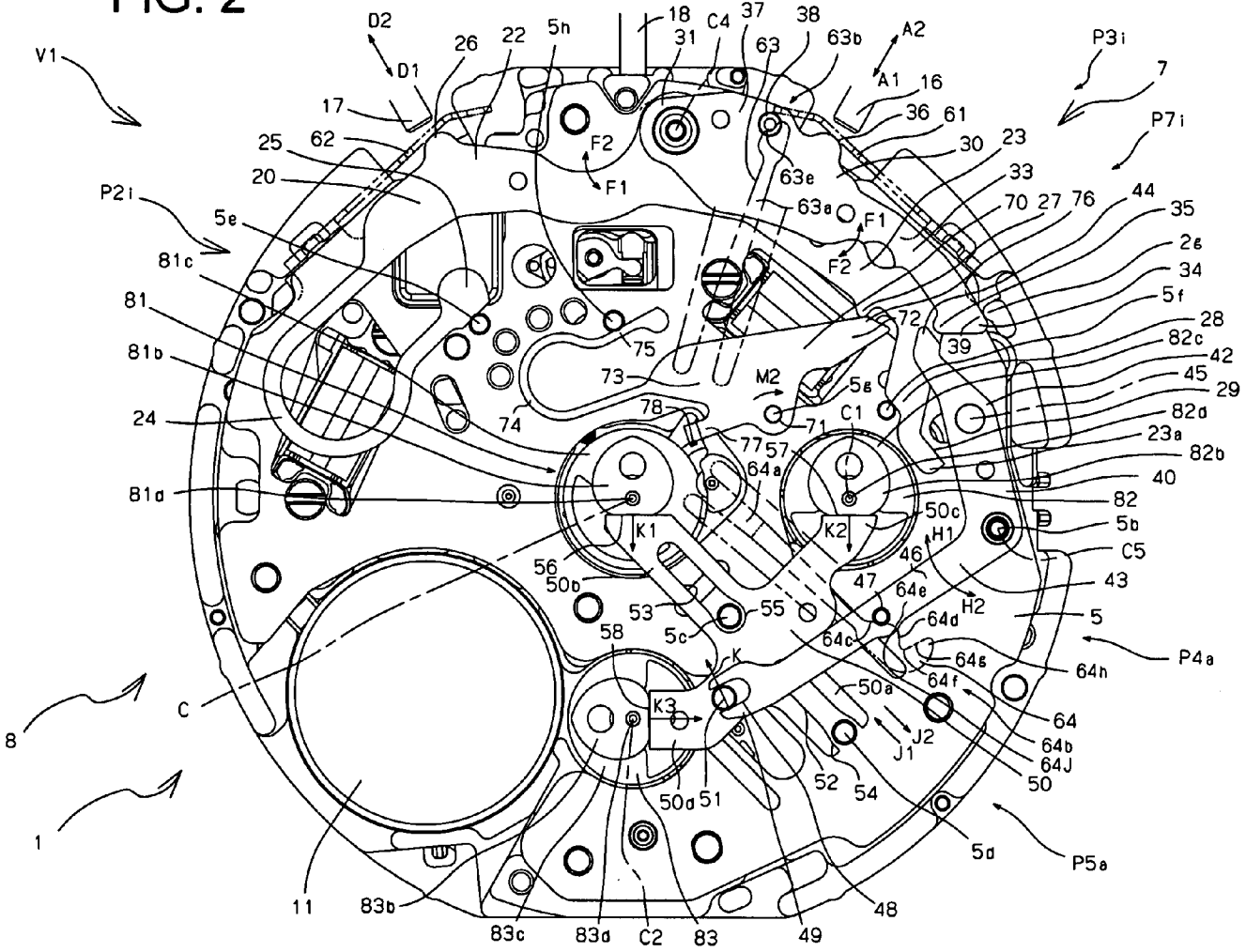
FIG. 2 is a plan view, when seen from the case back side, of the main body of the chronograph timepiece shown in FIG. 1, in which a battery connection (+) (plate) and a chronograph bridge are omitted, when the chronograph mechanism is in an initial state.
Figure 7:
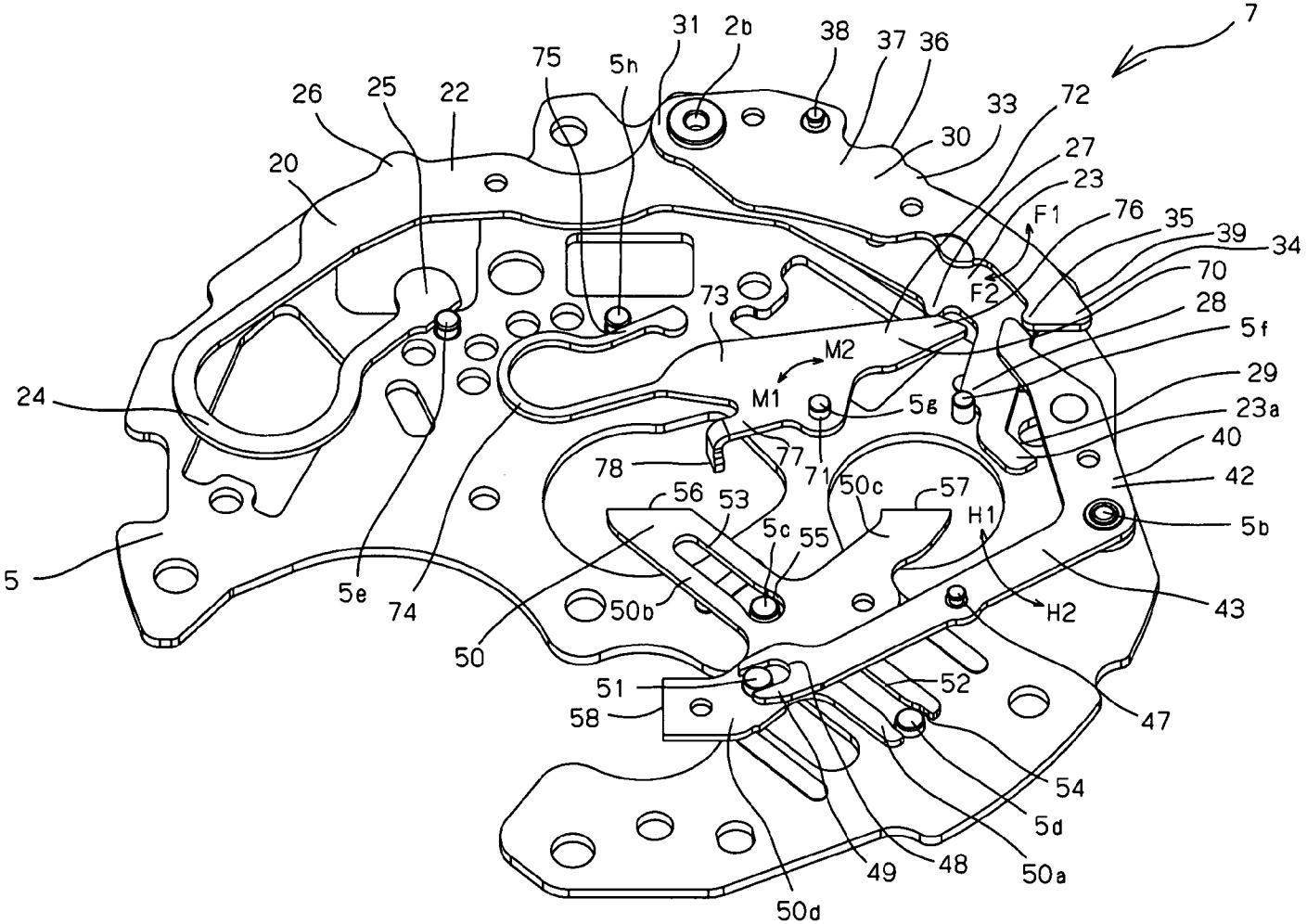
FIG. 7 is a perspective view of a mechanical chronograph mechanism of the chronograph timepiece shown in FIG. 1.

As shown in FIGS. 8, 7, 2, and the like, the chronograph lower plate 5 includes a hammer operating lever rotation center pin 5*b* (FIG. 8), a self alignment guide pins 5*c* and 5*d* of the hammer lever 50, a reset-to-zero instruction lever spring holding pin 5*e*, a reset-to-zero instruction lever locking pin 5*f*, a stop lever rotation center pin 5*g*, and a stop lever spring holding pin 5*h*.

In addition, the rotation center pin 2*b* is installed in a protruding manner in the main plate 2, and instead, may be installed in a protruding manner in the chronograph lower plate 5. In this case, all of the levers 20, 30, 40, 50 and 70 constituting the mechanical chronograph mechanism 7 are supported the chronograph lower plate 5 in the chronograph bridge 6 side of the chronograph lower plate 5.

The reset-to-zero instruction lever 20, as can be seen from FIGS. 8, 7, 2, and the like, includes a hole portion 21 (FIG. 8), an input side arm portion 22 positioned at one end of the hole portion 21, and an output side arm portion 23 positioned at the other end of the hole portion 21, and a spring portion 24 which is curved in a U shape is installed in the end portion of the input side arm portion 22. The reset-to-zero instruction lever 20 is slidably rotate supported by the reset-to-zero instruction lever fitting portion 2*c* of the rotation center pin 2*b* in the directions F1 and F2 in the central hole portion 21, and is engaged with the reset-to-zero instruction lever spring holding pin 5*e* in a forward end portion 25 of the spring portion 24. In other words, the reset-to-zero instruction lever 20 can rotate in the directions F1 and F2 between the initial position P2*i* (FIG. 2 or the like) and the operating position P2*a* (FIG. 6 or the like).

The reset-to-zero instruction lever 20 includes an instruction holding protruding portion 26 in an outside portion of the input side arm portion 22. The reset-to-zero instruction lever 20 also includes a stop lever locking protrusion 27 in an inner edge of the output side arm portion 23, a locking edge portion 28 in an inner edge of the vicinity of the forward end portion, and an engagement edge portion 29 in the forward end portion 23*a*.

Therefore, the reset-to-zero instruction lever 20, as shown in FIG. 2, or the like, is applied with a rotation bias force in the direction F2 by the spring portion 24 in a state where an external force is not applied, and lies at an initial position P2*i* at which the locking edge portion 28 is locked in the reset-to-zero instruction lever locking pin 5*f*. On the other hand, if the reset-to-zero button 17 is forced to be inserted in the direction D1, a pressing force in the direction D1 of the reset-to-zero button 17 is applied to the protruding portion 26 of the input side arm portion 22 of the reset-to-zero instruction lever 20, and the reset-to-zero instruction lever 20 rotates around the rotation center axis 2*b* in the direction F1 (as long as the hammer operating lever 40 is not in such a state that reaches an operating position (reset-to-zero operating position) P4*a* which is a reset-to-zero operating control position described latter due to a reset operation) so as to be engaged with the hammer operating lever 40 in the engagement edge portion 29 positioned at the forward end of the output side arm portion 23.

The start-stop lever 30, as can be seen from FIGS. 8, 7, 2, and the like, includes a hole portion 32 (FIG. 8) positioned around one end portion 31 which is a rear anchor portion, an arm portion 33 extending in one direction from the hole portion 32, and a protruding portion 35 for the pressing hammer operating lever in one side of the extending end portion 34 of the arm portion 33. The start-stop lever 30 is supported by the start-stop lever fitting portion 2*d* of the common rotation center pin 2*b* so as to rotate around the central axis line C4 in the directions F1 and F2 in the hole portion 32 of the rear anchor portion 31. That is to say, the start-stop lever 30 can rotate in the directions F2 and F1 between the initial position P3*i* (FIG. 2 or the like) and the operating position P3*a* (FIG. 4 or the like).

Since the start-stop lever 30 is supported so as to rotate in the rotation center pin 2*b* which is common to or the same as the reset-to-zero instruction lever 20 and thereby is configured to rotate around the common rotation central axis line C4, rotation regions of the two levers 20 and 30 are actually shared, and thus it is possible to suppress an occupying area to the minimum. In addition, since the common rotation central axis line C4 is positioned between the start-stop button 16 and the reset-to-zero button 17, the start-stop lever 30 which rotates when the start-stop button 16 is forced to be inserted in the direction A1 and the reset-to-zero instruction lever 20 which rotates when the reset-to-zero button 17 is forced to be inserted in the direction D1 can be engaged with the hammer operating lever 40 in a reverse direction such that the hammer operating lever 40 rotates in the reverse direction.

The start-stop lever 30 includes a protruding portion 36 in an edge portion of the arm portion 33, and a pin-shaped protrusion 38 which is engaged with a start-stop switch spring portion 63 of the battery connection (+) 60 at a main surface (a main surface in the case back side) 37 facing the battery connection (+) 60 in a region between the hole portion 32 of the arm portion 33 and the protruding portion 36. Also, the start-stop lever 30 includes an engagement edge portion 39 which is locked in a locking protrusion 2*g* of the main plate 2 in a forward end outer edge portion.

As can be seen from FIGS. 1, 4, and the like, the start-stop switch spring portion 63 includes a thin and long body portion 63*a* and a forward end engagement portion 63*b* installed around the forward end of the spring body portion 63*a*. The forward end engagement portion 63*b* includes a rear anchor side long lateral surface 63*c* connected to the spring body portion 63*a*, a forward end side end lateral surface 63*d*, and a shoulder portion 63*e* which connects both the lateral surfaces and which has a stepwise shape. The protrusion 38 of the start-stop lever 30 can be displaced between a position where it comes into contact with the forward end side end lateral surface 63*d* and the shoulder portion 63*e* and a position (FIG. 4) where it comes into contact with the rear anchor side long lateral surface 63*c* in a state where the spring body portion 63*a* is curved in the direction G1.

Therefore, the start-stop lever 30 is applied with a rotation bias force in the direction F1 by the shoulder portion 63*e* of the start-stop switch spring portion 63 in a state of not being applied with an external force, and lies at the initial position P3*i* where the engagement edge portion 39 is locked in the locking protrusion 2*g*. On the other hand, if the start-stop button 16 is forced to be inserted in the direction A1, as shown in FIG. 4, a pressing force in the direction A1 of the start-stop button 16 is applied to the protruding portion 36 of the start-stop lever 30, the start-stop lever 30 rotates around the rotation center pin 2*b* in the direction F2, and (in a case where the hammer operating lever 40 does not return to an initial position (non-reset-to-zero position) P4*i* which is a start-stop control position described later) is engaged with the hammer operating lever 40 by the protruding portion 35 for the pressing hammer operating lever positioned at one side of the extending end portion 34 of the arm portion 33. When the start-stop lever 30 rotates in the direction F2, the pin-shaped protrusion 38 of the start-stop lever 30 causes the start-stop switch spring portion 63 to be curved in the direction G1. If the pin-shaped protrusion 38 is displaced along the rear anchor side long lateral surface 63*c* exceeding the shoulder portion 63*e*, the resistance of the start-stop button 16 to the forced insertion in the direction A1 is rapidly decreased, thereby giving a clicked sense to an operator. If the pressing in the direction A1 of the start-stop button 16 is released, a force for the main body 63*a* of the start-stop switch spring portion 63 to return in the direction G2 acts, and thereby the protrusion 38 of the start-stop lever 30 returns from the position where it is engaged with the rear anchor side long lateral surface 63*c* of the forward end engagement portion 63*b* to the position where it is engaged with the forward end side end lateral surface 63*d*, thereby the start-stop lever 30 returns in the direction F1 (for example, see FIG. 5), and in turn, the start-stop button 16 also returns in the direction A2.

The hammer operating lever 40, as can be seen from FIGS. 8 and 7, or FIGS. 6 and 4, or the like, includes a hole portion 41 (FIG. 8), an input side arm portion 42 positioned at one end of the hole portion 41, and an output side arm portion 43 positioned at the other end of the hole portion 41. The hammer operating lever 40 is supported by a hammer operating lever fitting portion 5*j* of a rotation center pin 5*b* in the central hole portion 41 so as to rotate around the central axis line C5 in the directions H1 and H2. The input side arm portion 42 includes a start-stop lever engagement portion 44 in one edge of the forward end and a pin-shaped protrusion 45 for engagement with reset-to-zero instruction lever 20 which protrudes from the main surface of a side facing the chronograph lower plate 5.

In other words, the hammer operating lever 40 can rotate in the directions H1 and H2 between the initial position (a non-reset-to-zero operating position) P4*i* (FIG. 4, FIG. 5, or the like) which is a start-stop control position and an operating position (a reset-to-zero operating position) P4*a* (FIG. 6, FIG. 2, or the like) which is a reset-to-zero operating control position. As shown in FIG. 2, when the hammer operating lever 40 lies at the operating position (the reset-to-zero operating position) P4*a*, if the start-stop lever 30 rotates in the direction F2 from the initial position P3*i* to the operating position P3*a*, the protruding portion 35 for pressing the hammer operating lever of the start-stop lever 30 comes into contact with the start-stop engagement portion 44 of the input side arm portion 42 of the hammer operating lever 40 and thus causes the hammer operating lever 40 to rotate towards the non-reset-to-zero operating position P4*i* in the direction H2 (FIG. 4). On the other hand, as shown in FIG. 4 or 5, when the hammer operating lever 40 lies at the initial position (non-reset-to-zero operating position) P4*i*, if the reset-to-zero instruction lever 20 rotates in the direction F1 from the position P2*i* to the position P2*a*, the engagement edge portion 29 of the reset-to-zero instruction lever 20 comes into contact with the pin-shaped protrusion 45 for engagement with reset-to-zero instruction lever of the input side arm portion 42 of the hammer operating lever 40 and causes the hammer operating lever 40 to rotate towards the reset-to-zero operating position P4*a* in the direction H1 (FIG. 6).

The hammer operating lever 40 includes a pin-shaped protrusion 47 which is engaged with a hammer operating lever switch spring portion 64 in a main surface (a main surface of the case back side) 46 of a side facing the battery connection (+) 60 inside the output side arm portion 43, and a hammer lever operating unit 49 which has a U-shaped and concaved engagement groove portion 48 where a hammer lever operating pin 51 of the hammer lever 50 is fitted and engaged with allowance in the forward end portion.

The hammer operating lever switch spring portion 64 with which the pin-shaped protrusion 47 is engaged includes a long and thin spring-like main body portion 64*a* and a forward end engagement portion 64*b*. The forward end engagement portion 64*b* includes a convex portion 64*e* having tilted portions 64*c* and 64*d*, and a protrusion 64*h* which gives a tilted portion 64*g* which forms a concave portion 64*f* together with the forward end side tilted portion 64*d*. A rear anchor side tilted portion 64*c* is consecutively connected to a lateral edge of the main body portion 64*a*.

Figure 5:
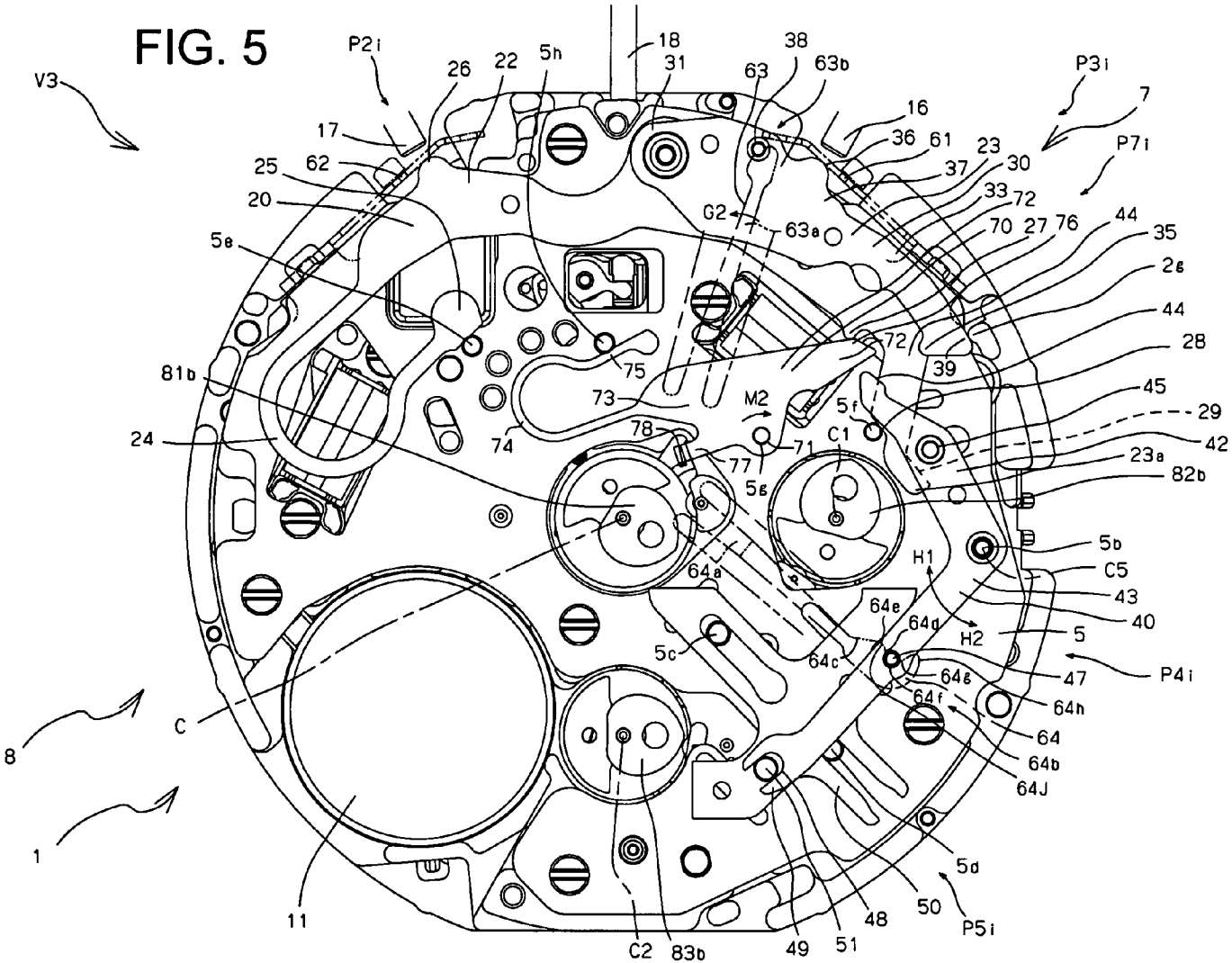
FIG. 5 is a plan view, which is the same as FIG. 2, illustrating a state where chronograph measurement action is performed after the start-stop button (start/stop button) of the chronograph timepiece shown in FIG. 1 is pressed.

Therefore, the pin-shaped protrusion 47 of the hammer operating lever 40 is movable between the state where it is positioned inside the concave portion 64*f* in the forward end side tilted portion 64*d* side of the convex portion 64*e* (corresponding to the initial position (non-reset-to-zero operating position) P4*i* of the hammer operating lever 40 as shown in FIG. 4 or 5) and the state where it is positioned in the rear anchor side tilted portion 64*c* of the convex portion 64*e* (the operating position (corresponding to the reset-to-zero operating position) P4*a* of the hammer operating lever 40 as shown in FIG. 6 or 2). The operating position (reset-to-zero operating position) P4*a* of the hammer operating lever 40 is accurately a position of the hammer operating lever 40 in such a position that the hammer lever 50 lies at an operating position (reset-to-zero operating position) P5*a* described later. When the pin-shaped protrusion 47 of the hammer operating lever 40 is positioned at a tip 64*j* of the convex portion 64*e*, the reset-to-zero operation is not performed yet (at least not completed) by the hammer lever 50.

That is to say, if the hammer operating lever 40 is rotated in the direction H2 by the start-stop lever 30 and the pin-shaped protrusion 47 exceeds the tip 64*j* of the convex portion 64*e* of the hammer operating lever switch spring portion 64, it is displaced along the forward end side tilted portion 64*d* under the acting of a spring force of the hammer operating lever switch spring portion 64, and thus the hammer operating lever 40 further rotates in the direction H2 and finally reaches the initial position (non-reset-to-zero operating position) P4*i* and causes the hammer lever 50 to be displaced to the non-reset-to-zero position (open position) P5*i* via the hammer lever operating pin 51 which is inserted into and engaged with the U-shaped engagement groove portion 48 with allowance (for example, FIG. 4).

When the pin-shaped protrusion 47 is positioned inside the concave portion 64*f* of the hammer operating lever switch spring portion 64 and the hammer operating lever 40 lies at the initial position (non-reset-to-zero operating position) P4*i*, the hammer operating lever 40 rotates in the direction H2 to the maximum, thus the start-stop lever engagement portion 44 of the hammer operating lever 40 lies at a rotation position in the direction H2 to the maximum. Thereby, the start/stop button (start-stop button) 16 is forced to be inserted in the direction A1 to the maximum in this state P4*i*, and thus even if the start-stop lever 30 rotates in the direction F2 to the maximum, the protruding portion 35 for pressing the hammer operating lever of the start-stop lever 30 does not come into contact with the start-stop lever engagement portion 44 of the hammer operating lever 40 but is positioned in a gap Q1 (see FIG. 4) between the protruding portion 35 for pressing the hammer operating lever of the start-stop lever 30 and the start-stop lever engagement portion 44 of the hammer operating lever 40. Therefore, in this state P4*i*, even if the start/stop button (start-stop button) 16 is rapidly forced to be inserted in the direction A1 to the maximum by an impact or the like and thus the start-stop lever 30 rotates in the direction F2 to the maximum, there is no concern that the protruding portion 35 for pressing the hammer operating lever of the start-stop lever 30 collides with the start-stop lever engagement portion 44 of the hammer operating lever 40, and it is possible to prevent the impact from being transmitted.

When the pin-shaped protrusion 47 exceeds the convex portion 64*e* of the hammer operating lever switch spring portion 64 to be positioned in the rear anchor side tilted portion 64*c* side and in turn the hammer operating lever 40 lies at the operating position (reset-to-zero operating position) P4*a*, the hammer operating lever 40 rotates in the direction H1 to the maximum and thus the pin-shaped protrusion 45 for engagement with the reset-to-zero instruction lever of the hammer operating lever 40 rotates in the direction H1 to the maximum to be positioned. Thereby, in this state P4*a*, even if the reset button (reset-to-zero button) 17 is forced to be inserted in the direction D1 to the maximum in this state and the reset-to-zero instruction lever 20 rotates in the direction F1 to the maximum, the engagement edge portion 29 of the reset-to-zero instruction lever 20 does not come into contact with the pin-shaped protrusion 45 for engagement with the reset-to-zero instruction lever of the hammer operating lever 40 and is positioned in a gap Q2 (see FIG. 6) between the engagement edge portion 29 of the reset-to-zero instruction lever 20 and the pin-shaped protrusion 45 for engagement with reset-to-zero instruction lever of the hammer operating lever 40. Therefore, in this state P4*a*, even if the reset button (reset-to-zero button) 17 is rapidly forced to be inserted in the direction D1 to the maximum by an impact or the like and thus the reset-to-zero instruction lever 20 rotates in the direction F1 to the maximum, there is no concern that the engagement edge portion 29 of the reset-to-zero instruction lever 20 collides with the pin-shaped protrusion 45 for engagement with reset-to-zero instruction lever of the hammer operating lever 40, and it is possible to prevent the impact from being transmitted.

On the other hand, if the hammer operating lever 40 is rotated in the direction H1 by the reset-to-zero instruction lever 20 and thus the pin-shaped protrusion 47 exceeds the tip 64*j* of the convex portion 64*e* of the hammer operating lever switch spring portion 64, it is displaced along the rear anchor side tilted portion 64*c* under the action of the spring force of the hammer operating lever switch spring portion 64, and thus the hammer operating lever 40 further rotates in the direction H1, and finally reaches the operating position (reset-to-zero operating position) P4*a* and causes the hammer lever 50 to be displaced to the reset-to-zero position P5*a* via the hammer lever operating pin 51 which is inserted into and engaged with the U-shaped and concaved engagement groove portion 48 (for example, FIG. 6).

A stop lever 70, as can be seen from FIGS. 3, 7, 6, 5, and the like, includes a hole portion 71 (FIG. 3), a first arm portion 72 positioned at one end of the hole portion 71, and a second arm portion 73 positioned at the other end of the hole portion 71. A spring portion 74 which is curved in a U shape is installed in the end portion of the second arm portion 73. The stop lever 70 is supported by a rotation center pin 5*g* in the central hole portion 71 so as to rotate in the directions M1 and M2 and is engaged with the stop lever spring holding pin 5*h* in a forward end portion 75 of the spring portion 74.

The stop lever 70 further includes a locked portion 76 in the outer lateral portion of the first arm portion 72. The stop lever 70 also includes a chronograph intermediate wheel setting edge portion 78 which can be bent in the thickness direction T of the chronograph timepiece 1 and extends in the thickness direction T and protrudes in the lateral direction, in a split arm portion 77 of the second arm portion 73.

The stop lever 70 can rotate in the directions M1 and M2 between the initial position (nonstop position) P7*i* (FIG. 2 or the like) and the operating position (stop position) P7*a* (FIG. 6 or the like).

The stop lever 70, as shown in FIG. 2, 4, or the like, resists the spring force of the spring portion 74 and lies at the nonstop position P7*i* after rotating in the direction M2, in a state where the locked portion 76 of the first arm portion 72 is locked in the stop lever locking protrusion 27 of the reset-to-zero instruction lever 20 lying at the non-operating position P2*i*. When the stop lever 70 lies at the nonstop position P7*i*, the chronograph intermediate wheel setting edge portion 78 of the split arm portion 77 of the stop lever 70 reaches a position spaced apart from a second chronograph second intermediate wheel 84*b* and allows the second chronograph second intermediate wheel 84*b* to rotate.

On the other hand, if the reset-to-zero instruction lever 20 rotates in the direction F1, the locked portion 76 of the first arm portion 72 is unlocked from the stop lever locking protrusion 27 of the reset-to-zero instruction lever 20. Therefore, the stop lever 70 is rotated in the direction M1 by the force of the spring portion 74 reaching the operating position (stop position) P7*a* where the chronograph intermediate wheel setting edge portion 78 of the split arm portion 77 of the stop lever 70 is engaged with the second chronograph second intermediate wheel 84*b* and thus sets the second chronograph second intermediate wheel 84*b*. Thus, a second chronograph wheel 81*c* engaged with the second chronograph second intermediate wheel 84*b* is prohibited from rotating.

At the timing when the stop lever 70 reaches the stop position P7*a*, the heart cams 81*b*, 82*b* and 83*b* are mechanically reset to zero by hammers 56, 57 and 58 of the hammer lever 50, as described later. If the heart cams 81*b*, 82*b* and 83*b* are reset to zero slightly earlier than the timing, the second chronograph wheel, the second chronograph second intermediate wheel 84*b*, the second chronograph first intermediate wheel 84*a*, and the chronograph operating rotor 13 do not return.

The hammer lever 50 has a form of a flying bird and includes a head portion side an arm portion 50*a*, a trunk-tail portion side arm portion 50*b*, and wing side arm portions 50*c* and 50*d*.

In the head portion side arm portion 50*a* of the hammer lever 50, a guide groove portion 52 which constitutes a hammer lever guide portion which has a thin and long opening shape or an elongated hold shaped portion for guide is provided. In the trunk-tail portion side arm portion 50*b* of the hammer lever, a guide hole portion or a guide hole portion 53 which constitutes a hammer lever guide portion having a thin and long opening shape or an elongated hole shaped portion for a guide, together with the guide groove portion 52, is provided. The guide groove portion 52 and the guide hole portion 53 is fitted to first and second hammer lever guide pins 5*d* and 5*c* which are installed in a protruding manner on a surface facing the chronograph bridge 6 inside the chronograph lower plate 5. Here, there is a small gap between the outer periphery of the first and second hammer lever guide pins 5*d* and 5*c* and the inner surface of the guide groove portion 52 and the guide hole portion 53. Therefore, the hammer lever 50 can roughly move in the directions J1 and J2 along the extending direction of the guide groove portion 52 and the guide hole portion 53. Also, in one end of each of the guide groove portion 52 and the guide hole portion 53, there is a provision of a groove part 54 and a hole part 55 slightly larger than the other portions of the groove portion 52 and the hole portion 53. Therefore, in a case where the first and second hammer lever guide pins 5*d* and 5*c* are positioned inside the groove part 54 and the hole part 55, the direction of the hammer lever 50 can vary. Here, a displacement guiding mechanism of the hammer lever 50 is constituted by the first and second hammer lever guide pins 5*d* and 5*c* and the guide groove portion 52 and the guide hole portion 53.

A hammer lever operating pin 51 as a force input portion is provided in a protruding manner in the right wing side arm portion 50*d* of the hammer lever 50, and the hammer lever operating pin 51 is fitted to the U-shaped groove portion 48 of the hammer lever operating unit 49 of the output side arm portion 43 of the hammer operating lever 40, is applied with an operating force K along the rotation direction H1 of the hammer operating lever 40 and is displaced in the direction J1.

The hammer lever 50 includes a second heart cam contact portion 56 (hammer portion) as a second hammer in the forward end portion of the trunk-tail portion side arm portion 50*b*, a minute heart cam contact portion 57 (hammer portion) as a minute hammer in the forward end portion of the left wing side arm portion 50*c*, and an hour heart cam contact portion 58 (hammer portion) as an hour hammer in the forward end portion of the right wing side arm portion 50*d*.

Therefore, if the hammer operating lever 40 is rotated in the direction H1 by the pressing in the direction D1 of the reset button 17, the hammer lever 50 is applied with the force K due to the hammer lever operating unit 49 of the output side arm portion 43 of the hammer operating lever 40 in the hammer lever operating pin 51, is guided to the guide pins 5*d* and 5*c* by the guide groove 52 and the guide hole 53 to be displaced in the direction J1, comes into contact with or comes into pressing contact with the second heart cam 81*b* by the second heart cam contact portion 56, comes into contact with or comes into pressing contact with the minute heart cam 82*b* by the minute heart cam contact portion 57, and comes into contact with or comes into pressing contact with the hour heart cam 83*b* by the hour heart cam contact portion 58. Here, if the heart cam contact portions 56, 57 and 58, reach the regions to come into contact with the second, minute and hour heart cams 81*b*, 82*b* and 83*b*, the operating force K is towards a direction where an operating line thereof actually passes the central axis line C. If the contact state or the pressing contact state is achieved, since the guide pins 5*d* and 5*c* are exactly positioned inside the groove part 54 and the hole part 55 larger than the guide groove 52 and the guide hole 53, a state where the contact portions (hammers) 56, 57 and 58 of the hammer lever 50 exactly come into contact with or come into pressing contact with the minimal diameter portions of the corresponding heart cams 81*b*, 82*b* and 83*b* is realized. At this time, the force K which the hammer lever operating unit 49 of the output side arm portion 43 of the hammer operating lever 40 applies to the hammer lever 50 via the hammer lever operating pin 51 is exactly balanced with a total force of the force K1 which the second heart cam 81*b* applies to the hammer lever 50 by the second heart cam contact portion (second hammer) 56, the force K2 which the minute heart cam 82*b* applies to the hammer lever 50 by the minute heart cam contact portion (minute hammer) 57, and the force K3 which the hour heart cam 83*b* applies to the hammer lever 50 by the hour heart cam contact portion (hour hammer) 58, and the torque which the four forces K, K1, K2 and K3 applies to the hammer lever 50 is actually balanced. Thus, even if the walls around the groove part 54 and the hole part 55 do not actually apply a force for maintaining the guide pins 5*d* and 5*c*, the hammer lever 50 can be maintained to be still. In this state, the hammer lever 50 comes into pressing contact with the second heart cam 81*b*, the minute heart cam 82*b*, and the hour heart cam 83*b* by the second heart cam contact portion 56, the minute heart cam contact portion 57, and the hour heart cam contact portion 58, and causes the second chronograph wheel 81, the minute chronograph wheel 82, and the hour chronograph wheel 83 to be reset to zero. Thereby, a self-alignment is achieved.

Next, an operation and an action of the chronograph timepiece 1 configured as described above will be described based on FIGS. 2, 4 to 6 of FIGS. 1 to 10, and the flowchart in FIG. 11.

The mechanical chronograph mechanism 7 of the main body (movement) 8 of the chronograph timepiece 1 is in a state shown in FIG. 2 in the initial state V1. Here, the initial state V1 in the mechanical chronograph mechanism 7 refers to a state where the reset-to-zero is completed and then the reset-to-zero (reset) button 17 regresses in the direction D2 or returns to the protruding original position.

More specifically, in the initial state V1 in the mechanical chronograph mechanism 7, the reset-to-zero instruction lever 20 is rotatably biased to the direction F2 under the acting of the spring 24 and reaches the initial position P2*i* where it is locked in the locking pin 5*f* by the locking edge portion 28. In this initial position P2*i*, the stop lever locking protrusion 27 of the reset-to-zero instruction lever 20 presses the locked portion 76 of the stop lever 70 to cause the stop lever 70 to resist the spring force of the spring 74, and thereby it is set to the position P7*i* where it rotates in the direction M2. In addition, in the initial state V1 in the mechanical chronograph mechanism 7, the pin-shaped protrusion 38 is biased to the direction F1 by the shoulder portion 63*e* of the start-stop switch spring portion 63 and thus the start-stop lever 30 reaches the initial position P3*i* where it is locked in the locking protrusion 2*g* of the main plate 2 by the locked portion 39 positioned at the outer edge of the end portion 34. In addition, the initial state V1 in the mechanical chronograph mechanism 7, the hammer operating lever 40 rotates in the direction H1 to the maximum to reach the operating position P4*a*. In the operating position P4*a*, the pin-shaped protrusion 47 is engaged with the rear anchor side tilted portion 64*c* of the convex portion 64*e* of the hammer operating lever switch spring portion 64, and the hammer lever operating unit 49 is set to the reset-to-zero position P5*a* where the hammer lever 50 is displaced in the direction J1 to the maximum. In other words, in the reset-to-zero position P5*a*, the hammers 56, 57 and 58 of the hammer lever 50 come into pressing contact with the corresponding heart cams 81*b*, 82*b* and 83*b*, thereby setting the heart cams 81*b*, 82*b* and 83*b* to the reset-to-zero position.

In this initial state V1, if the start-stop (start/stop) button 16 is pushed down in the direction A1, it comes to an instruction state of starting chronograph measurement V2 shown in FIG. 4.

If the start-stop button 16 is pushed down, the start-stop switch lever portion 61 is pressed and thus the forward end portion 61*a* comes into contact with the contact point positioned in the lateral surface of the circuit board (not shown), thereby turning on a switch (contact point) to generate the chronograph measurement starting signal S1 shown in FIG. 11(*a*). Therefore, a driving of the chronograph hand operation motor 13 starts, and if there is a counter (not shown), the counter starts the measurement. On the other hand, the start-stop lever 30 which is applied with the push-down force in the direction A1 of the start-stop button 16 by the protruding portion 36 rotates in the direction F2. When the pin-shaped protrusion 38 of the start-stop lever 30 deviates from the shoulder portion 63*e* of the start-stop switch spring portion 63 according to the rotation direction F2 and is displaced along the rear anchor side long lateral surface 63*c*, an operator can obtain a clicked sense for the push-down force in the direction A1 of the start-stop button 16. When the start-stop lever 30 rotates in the direction F2, the start-stop lever 30 reaches the operating position P3*a*. The operating position P3*a* is a position when the start-stop button 16 is forced to be inserted in the direction A1 exceeding a predetermined range (such that the heart cams are unlocked), and, for example, it may be a maximally forced insertion position or a position in the vicinity thereof. In the initial position P4*i* according to the rotation direction F2 of the start-stop lever 30, the hammer operating lever 40 is applied with a pressing force in the direction F2 from the protruding portion 35 of the start-stop lever 30 by the start-stop engagement portion 44 and thus rotates in the direction H2. The pin-shaped protrusion 47 of the hammer operating lever 40 exceeds the tip 64*j* of the convex portion 64*e* of the hammer operating lever switch spring portion 64 and moves to the tilted surface 64*d* from the tilted surface 64*c*. (When the pin-shaped protrusion 47 exceeds the tip 64*j*, an operator receives a second clicked sense. For example, if an initial measurement start is to felt stronger than a measurement stop or a measurement restart, the second clicked sense is set to be stronger, and if the initial measurement start is to be felt the same degree as the measurement stop or the measurement restart, the second clicked sense is set to be weaker or is set to generate a clicked sense roughly at the same time.) Thereafter, the hammer operating lever 40 is applied with a rotational force in the direction H2 from the hammer operating lever switch spring portion 64. As a result, even if the start-stop lever engagement portion 44 of the hammer operating lever 40 deviates from the protruding portion 35 of the start-stop lever 30, the pin-shaped protrusion 47 further rotates in the direction H2, and when the pin-shaped protrusion 47 reaches the bottom of the concave portion 64*f*, the hammer operating lever 40 stops rotating in the direction H2, and then the hammer operating lever 40 reaches the initial position P4*i*. In addition, the hammer operating lever 40 rotates in the direction H2 from the operating position P4*a* to the initial position P4*i*, and thereby the hammer lever 50, which is engaged with the hammer lever operating unit 49 of the hammer operating lever 40 by the operating pin 51, also returns to the initial position (open position) P5*i* from the operating position (reset-to-zero position) P5*a*, and the hammers 56, 57 and 58 completely remove the settings of the heart cams 81*b*, 82*b* and 83*b*. Therefore, the chronograph hands 81*a*, 82*a* and 83*a* start working according to the chronograph measurement.

Also, in this state V2, since there is the gap Q1 (FIG. 4) between the start-stop lever engagement portion 44 of the hammer operating lever 40 and the protruding portion 35 of the start-stop lever 30, for example, even when an impact in the direction A1 is applied to the start-stop button 16, there is no concern that the impact is transmitted to other levers and there is little concern that mechanical chronograph mechanism 7 is damaged.

Next, if the push-down in the direction A1 of the start-stop button 16 is stopped, it comes to a chronograph measurement state V3 shown in FIG. 5. In the chronograph measurement state V3, the switch lever portion 61 returns in the direction B2 and the start-stop button 16 returns in the direction A2 by the restoring force. By the restoring force in the direction G2 of the switch spring portion 63, the start-stop lever 30 also returns and rotates in the direction F1 and in turn returns to the initial position P3*i* where it is locked in the locking protrusion 2*g* by the locked portion 39. The measurement state V3 is the same as the state V2 in FIG. 4 in other points.

If the start-stop button 16 is pressed during the chronograph measurement, an action as shown in FIG. 11(*b*) is performed, turns to the state V2 in FIG. 4 again, and then returns to the state V3 in FIG. 5.

That is to say, the start-stop button 16 is pushed down in the direction A1, thus the switch lever portion 61 fluctuates in the direction B1 to cause the switch contact point to be turned on, and thereby the stop signal S1 as the start-stop signal is generated so as to stop the chronograph hand operation motor 13. On the other hand, since the start-stop lever 30 rotates in the direction F2 due to the push-down in the direction A1 of the start-stop button 16, when the switch spring portion 63 rotates in the direction G1 and exceeds the shoulder portion 63*e*, a clicked sense is given (the state V2 in FIG. 4), and when the switch spring portion 63 returns in the direction G2, the start-stop lever 30 returns in the direction F1 (the state V3 in FIG. 5).

If the start-stop button 16 is pushed secondly during the stop of the chronograph measurement, an action is performed as shown in FIG. 11(*b*) (however, restarting of the chronograph measurement or the hand operating instead of the stopping of the chronograph measurement or the hand operating), turns to the state V2 in FIG. 4 again, and then returns to the state V3 in FIG. 5.

That is to say, the start-stop button 16 is pushed down in the direction A1, thus the switch lever portion 61 fluctuates in the direction B1 to cause the switch contact point to be turned on, and thereby the restart signal S1 as the start-stop signal is generated so as to start (secondly) the chronograph hand operation motor 13. On the other hand, since the start-stop lever 30 rotates in the direction F2 due to the push-down in the direction A1 of the start-stop button 16, when the switch spring portion 63 fluctuates in the direction G1 and exceeds the shoulder portion 63*e*, a clicked sense is given (the state V2 in FIG. 4), and when the switch spring portion 63 returns in the direction G2, the start-stop lever 30 returns in the direction F1 (the state V3 in FIG. 5).

The stop and restart of the above-described mechanical chronograph mechanism 7 are repeated according to the push-down and the stop thereof of the start-stop button 16.

In the state V3 in FIG. 5 (typically, which is the chronograph measurement stopped state, but may be chronograph measurement state), if the reset button 17 is pushed in the direction D1 to output a chronograph reset-to-zero instruction, it comes to be in the chronograph reset-to-zero instruction state V4 as shown in FIG. 6.

That is to say, by the pressing in the direction D1 of the reset (reset-to-zero) button 17, the reset-to-zero switch lever portion 62 is bent in the direction E1 and the forward end portion 62*a* comes into contact with the contact point in the lateral surface of the circuit board (not shown), thereby outputting the reset-to-zero instruction signal S2 as shown in FIG. 11(*c*) (when a timer counter or the like performs the chronograph measurement, the timer counter is reset).

On the other hand, the reset-to-zero instruction lever 20, which is applied with the pressing from the instruction holding protruding portion 26 by the pressing in the direction D1 of the reset-to-zero button 17, rotates in the direction F1. If the reset-to-zero instruction lever 20 begins to rotate in the direction F1, the locking protrusion portion 27 of the reset-to-zero instruction lever 20 instantly deviates from the locked portion 76 of the stop lever 70, then is unlocked from the stop lever 70, thus rotates in the direction M1 under the acting of the spring portion 74 of the stop lever 70, and reaches the operating position P7*a*. The setting edge portion 78 tightly presses the second chronograph second intermediate wheel 84*b* to set the second chronograph second intermediate wheel 84*b*, which causes the second chronograph wheel 81*c* engaged with the second chronograph second intermediate wheel 84*b* to stop rotating. When the reset-to-zero instruction lever 20 rotates in the direction F1, the engagement edge portion 29 of the reset-to-zero instruction lever 20 is engaged with the pin-shaped protrusion 45 of the hammer operating lever 40, and, in the initial position P4*i*, the hammer operating lever 40 rotates in the direction H1 via the pin-shaped protrusion 45. By the rotation in the direction H1 of the hammer operating lever 40, the pin-shaped protrusion 47 exceeds the tip 64*j* of the convex portion 64*e* from the concave portion 64*f* of the hammer operating lever switch spring portion 64 and moves to the rear anchor side tilted portion 64*c*. If the pin-shaped protrusion 47 exceeds the tip 64*j*, even when the pin-shaped protrusion 45 of the hammer operating lever 40 deviates from the engagement edge portion 29 of the reset-to-zero instruction lever 20, the hammer operating lever 40 is rotated in the direction H1 by the spring force of the switch spring portion 64. Therefore, the resistance to the pressing of the reset-to-zero button 17 is rapidly reduced, and thus an operator can feel a clicked sense. By the rotation in the direction H1 of the hammer operating lever 40, the hammer lever operating unit 49 of the hammer operating lever 40 presses the hammer lever 50 in the direction K via the operating pin 51. The hammer lever 50 moves in the direction J1 and is guided to the groove portion 52 and the hole portion 53 with which the guide pins 5*d* and 5*c* are engaged, and particularly, the direction or position thereof is adjusted (the self-alignment is performed) by the large diameter portions 54 and 55, and thereby the heart cams 81*b*, 82*b* and 83*b* are forced to be reset to zero by the hammers 56, 57 and 58. As a result, the hammer operating lever 40 reaches the operating position P4*a* and the hammer lever 50 also reaches the operating position P5*a*.

Since, in this state V4, the reset-to-zero button 17 is forced to be inserted in the direction D1 to the maximum, and there is the gap Q2 (FIG. 6) between the engagement edge portion 29 of the reset-to-zero instruction lever 20 and the pin-shaped protrusion 45 of the hammer operating lever 40 even when the reset-to-zero instruction lever 20 rotates in the direction F1 to the maximum, even if an unpredicted impact is applied to the reset-to-zero button 17 in the direction D1, there is little concern that the impact is directly transmitted to other train wheels or the like.

Next, if the pressing is not applied from the reset button 17, under the acting of the spring 24, the reset-to-zero switch lever portion 62 returns in the direction E2, and the reset-to-zero instruction lever 20 returns to the initial position P2*i* where the locking edge portion 28 is locked in the locking pin 5*f*.

As a result, as shown in FIG. 2, the locking protrusion 27 of the reset-to-zero instruction lever 20 comes into contact with the locked portion 76 of the stop lever 70 again to cause the stop lever 70 to return to the initial position P7*i*, thereby removing the setting of the second chronograph second intermediate wheel 84*b*. However, the heart cams 81*b*, 82*b* and 83*b* are in a corrected reset-to-zero state by the hammers 56, 57 and 58, and the chronograph hand operation motor 13 is in a stopped state.

In the chronograph timepiece 1 configured as described above, generally, a desired reset-to-zero action can be reliably performed, but there remains a problem unique to the mechanical reset-to-zero mechanism using heart cams, that is, in a case where the hammer portion exactly comes into contact with the tip of the heart cam and enters a rare state where a force is applied to the heart cam towards the rotation center, the heart cam does not rotate in any direction and thus the reset-to-zero is difficult to perform.

Figure 12:
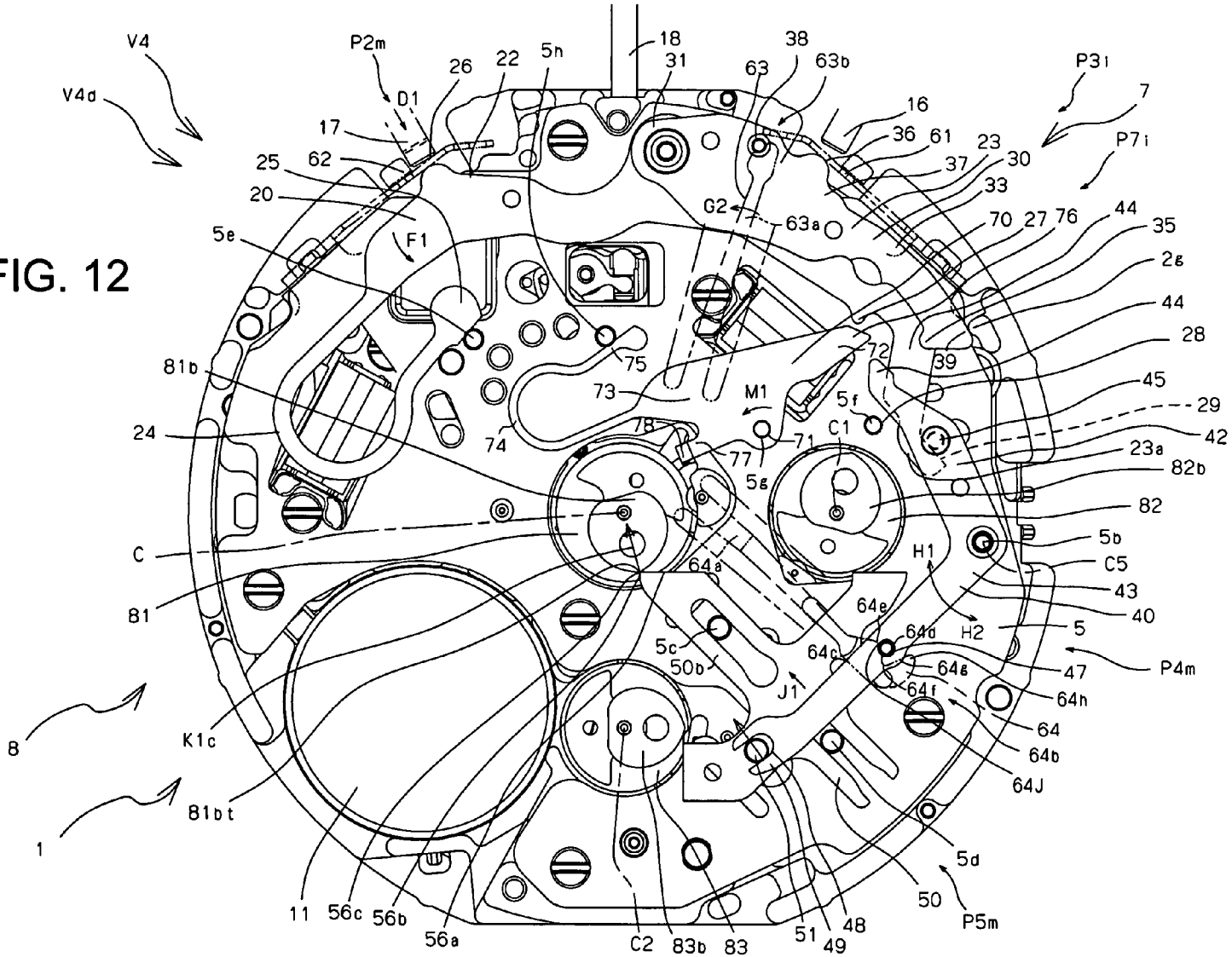
FIG. 12 is a plan view, which is the same as FIG. 2, illustrating a state of the chronograph timepiece shown in FIG. 1 where resetting-to-zero of a heart cam, which seldom occurs but may occur in a case where a hammer lever has the elongated hole for guide as shown in FIG. 2, is not commonly performed.

More specifically, when the second chronograph wheel 81 further rotates in the chronograph measurement state V3 in FIG. 5 and then is set to the chronograph measurement stopped state V3 by the push-down of the start-stop button 16, the second chronograph wheel 81, the minute chronograph wheel 82, and the hour chronograph wheel 83 reach the rotation position shown in FIG. 12. At this time, if the reset-to-zero instruction is made through forced insertion in the direction D1 of the reset-to-zero button 17, as shown in FIG. 12, the reset-to-zero instruction lever 20 rotates in the direction F1 to cause the hammer operating lever 40 to reach the reset-to-zero instruction middle position P4*m* where it rotates in the direction H1 from the initial position P4*i*. At this time, as shown in FIG. 12, the pin-shaped protrusion 47 of the hammer operating lever 40 is positioned halfway climbing the tilted portion 64*d* of the hammer operating lever switch spring portion 64 towards the tip 64*j*. In this way, the hammer operating lever 40 rotates halfway in the direction H1, and, thereby, the hammer lever 50 reaches the middle position P5*m* where it progresses to a certain degree in the direction J1 from the initial position P5*i* to the reset-to-zero position P5*a*. When the hammer lever 50 lies at such a middle position P5*m*, there is a rare case where the hammer portion of the hammer lever 50, in the example shown in the figure, the second hammer portion 56 comes into contact with the tip 81*bt* of the corresponding second heart cam 81*b* and, further, the force K1*c* is applied to the second hammer portion 56 towards the rotation center C.

In the example of the shown chronograph timepiece 1, the second hammer portion 56 has first and second contact surface portions 56*a* and 56*b* intersecting each other, and a tip portion 56*c* positioned between the contact surface portions 56*a* and 56*b*. The tip portion 56*c* which is a portion of the contact surface portions 56*a*, 56*b* and 56*c* of the second hammer portion 56 exactly comes into contact with the tip 81*bt* of the second heart cam 81*b*. However, this is true of a case where depending on a relative arrangement or a relative displacement direction of the hammer portion with respect to the heart cam, the hammer is provided with, for example, only a single planar contact surface portion instead of the plural contact surface portions.

Anyway, when the second hammer portion 56 (in the example shown in the figure, the tip portion 56*c*) applies the force K1*c* to the tip 81*bt* of the second heart cam 81*b* towards the rotation center C, there is a concern about a state where the second heart cam 81*b* cannot rotate in any direction and the trunk-tail portion side arm portion 50*b* including the second hammer portion 56 of the hammer lever 50 (therefore, the hammer lever 50 itself) is strutted by the second heart cam 81*b* and thus cannot move, that is, a kind of strut state V4*d*.

In this case, for example, by repeatedly pressing the reset-to-zero button 17 (and return due to the spring) so as to change the direction of the second heart cam 81*b*, it is necessary to perform the reset-to-zero action.

In order to solve the problem, the hammer lever 50 may fluctuate so as to change a relative position of the hammer portion which strikes the heart cam, with respect to the heart cam in the displacement position P5*d* in the direction J1 of the hammer lever 50.

Figure 13:
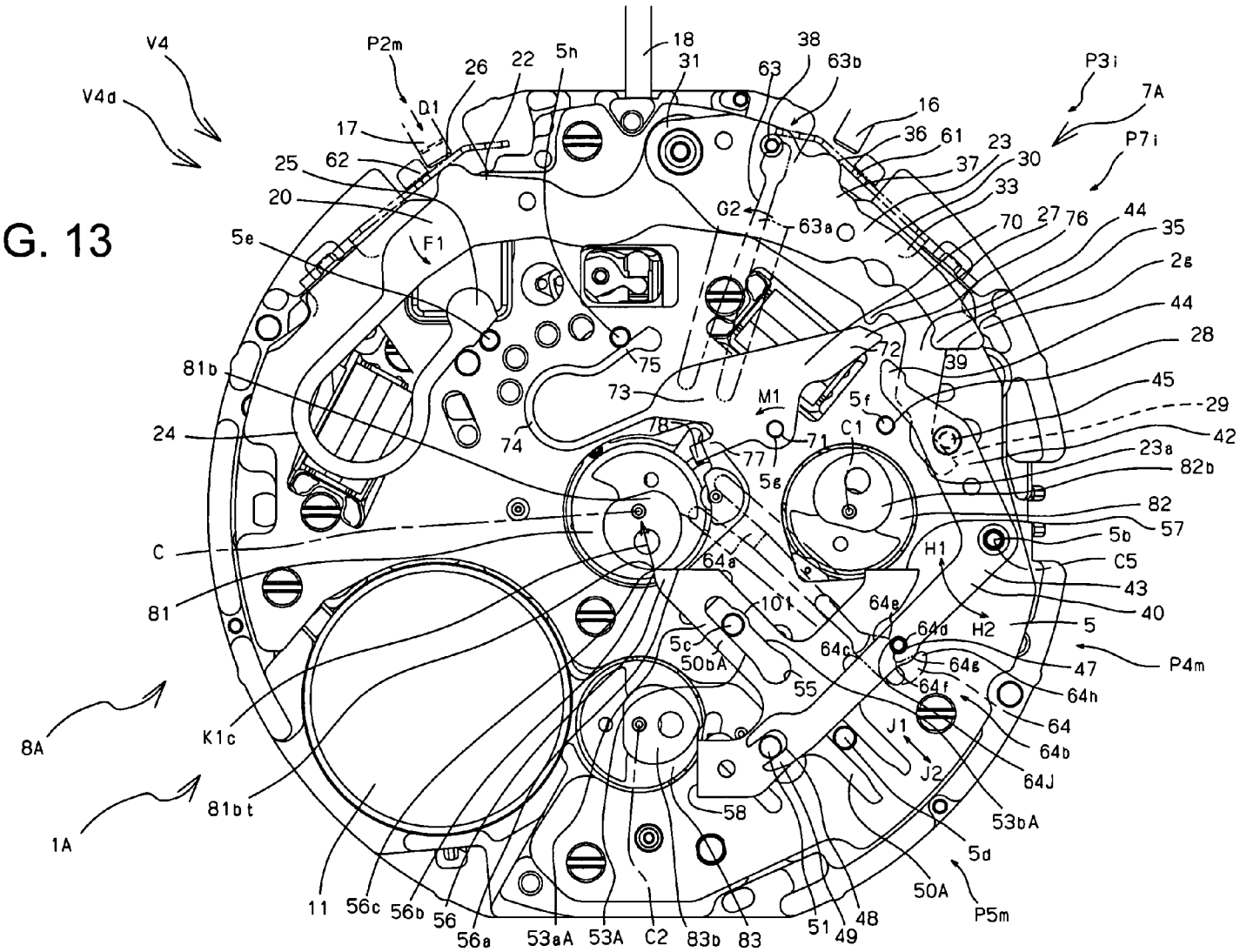
FIG. 13 is a plan view illustrating a state where the reset-to-zero action as in FIG. 12 is performed halfway in a chronograph timepiece according to another preferable embodiment of the present invention in order to prevent the event as shown in FIG. 12 from occurring (however, this is a state which transiently and temporarily occurs)

FIG. 13 shows a chronograph timepiece 1A which has a chronograph timepiece main body 8A including a mechanical chronograph mechanism 7A enabling escape from the above-described strut state (strut state) V4*d* (capable of preventing inextricability). In the chronograph timepiece 1A in FIG. 13, the same reference numerals are given to the same elements as those shown in FIGS. 1 to 12, and although different, a subscript A is added in the last of the same reference numerals in the corresponding elements.

Figure 15:
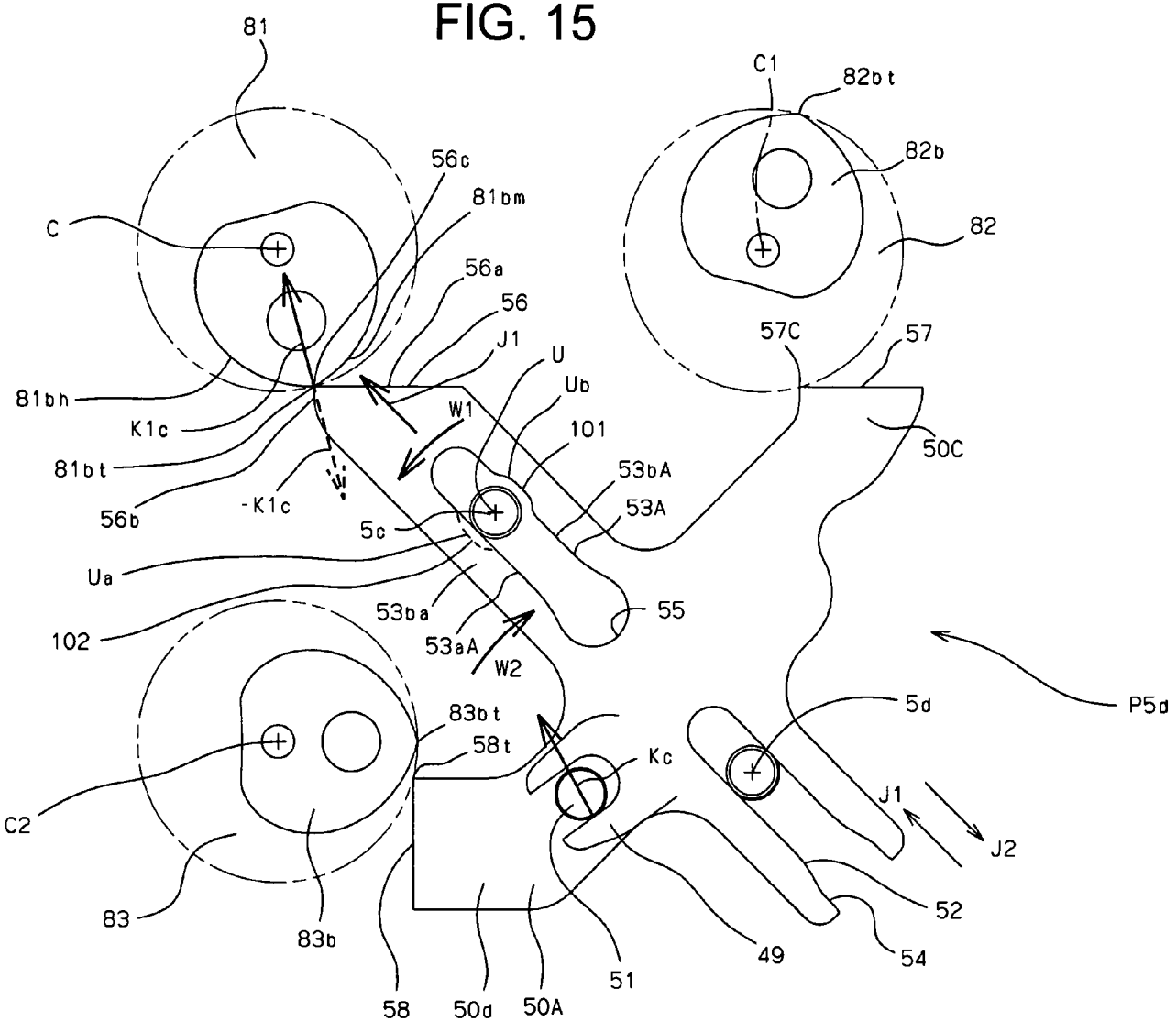
FIG. 15 is an enlarged plan view of the extracted hammer lever and the heart cam parts in the state shown in FIG. 13.

In the chronograph timepiece 1A, as can be seen from FIG. 13 and FIG. 15 which are diagrams shown by partial enlargement thereof, a guide hole portion 53A which is a guide elongated hole portion of a trunk-tail portion side arm portion 50*b*A of a hammer lever 50A, includes a concave portion 101 in a specific location Ub of one surface 53*b*A of lateral surfaces 53*a*A and 53*b*A. Here, FIG. 13 is a plan view, when seen from the case back side, in which the battery connection (+) (plate) and the chronograph bridge are omitted from the chronograph timepiece main body, in the same manner as in FIG. 2 or FIG. 12, in a case where the reset-to-zero process in the chronograph mechanism is performed halfway. FIG. 15 is an enlarged plan view of the hammer lever and the heart cam parts in FIG. 13.

The location Ub where the concave portion 101 is positioned, as can be seen from FIGS. 13 and 15, is a location of the lateral surface 53*b*A corresponding to a position U where the hammer lever guide pin 5*c* lies inside the elongated hole 53A for long guide, when the tip 56*c* of the second hammer 56 is exactly engaged with the tip 81*bt* of the second heart cam 81*b*.

Here, the structure and the state of the chronograph timepiece 1A in FIG. 13 is substantially the same as the structure and the state of the chronograph timepiece 1 in FIG. 12 except that the guide elongated hole 53A of the hammer lever 50 includes the concave portion 101 in the location Ub of the lateral surface 53*b*A.

In the states shown in FIGS. 13 and 15, the chronograph wheels 81, 82 and 83 rotate to a certain degree, and the chronograph measurement is in a still state when the second chronograph wheel 81 lies at a singular rotation position. The reset-to-zero button 17 is forced to be inserted in the direction D1 and this instructs the reset-to-zero, and in turn the reset-to-zero instruction lever 20 rotates in the direction F1 to cause the hammer operating lever 40 to reach the reset-to-zero instruction middle position P4*m* where it rotates in the direction H1 from the initial position P4*i*. The hammer operating lever 40 rotates halfway in the direction H1 and reaches the middle position P4*a* where the pin-shaped protrusion 47 of the hammer operating lever 40 is positioned halfway climbing the tilted portion 64*d* of the hammer operating lever switch spring portion 64 towards the tip 64*j*. When the hammer lever 50 reaches the middle position P5*m* where it moves to a certain degree in the direction J1 from the initial position P5*i* to the reset-to-zero position P5*a*, the second hammer portion 56 of the hammer lever 50 exactly comes into contact with the tip 81*bt* of the second heart cam 81*b* which sometimes lies at a singular rotation position and enters the strut state or the strut state V4*d* where the force K1*c* is applied to the second hammer portion 56 towards the rotation center C. In this strut state, the hammer lever 50A is displaced in the direction J1 from the initial position P5*i* to the operating position P5*a*, and thereby the front hammer lever guide pin 5*c* is displaced in the direction J2 relative to the guide elongated hole 53A to exactly reach the position U and to exactly face the concave portion 101 in the location Ub corresponding to the above-described position U.

In this strut state V4*d*, as can be seen from the enlarged view of FIG. 15, one side of the hammer lever 50A is applied with the reset-to-zero driving force Kc from the hammer lever operating unit 49 of the hammer operating lever 40 in the hammer lever operating pin 51 which is a force input portion, in the rotational direction H1 of the hammer lever operating unit 49 around the central axis line C5, and, the other side thereof is applied with the reaction −K1*c* of the force K1*c* which the tip 56*c* of the second hammer 56 applies to the tip 81*bt* of the second heart cam 81*b* towards the center C, from the second heart cam 81*b* by the tip 56*c* of the second hammer 56. In addition, in a state where the reset-to-zero instruction progresses halfway, as can be seen from the FIG. 15, since the minute hammer 57 and the hour hammer 58 have not come into contact with the corresponding minute heart cam 82*b* and the hour heart cam 83*b* yet, the hammer lever 50A is not applied with a force from the minute heart cam 82*b* or the hour heart cam 83*b*.

Further, in this strut state V4*d*, as can be seen from FIG. 15, the two forces K and −K1*c* prohibit translation in the direction in which the force K1*c* is applied or the elongated hole portion 53A extends, but, as a whole, gives torque to the hammer lever 50A and causes the hammer lever 50A to fluctuate around the rear hammer lever guide pin 5*d* in the direction W1. Here, since the hammer lever 50A is exactly provided with the concave portion 101 in the location Ub, the concave portion 101 allows the hammer lever 50A to fluctuate in the direction W1, and when the hammer lever 50A fluctuates in the direction W1, the front hammer lever guide pin 5*c* enters the concave portion 101. In other words, the hammer lever 50A moves from the strut state P5*d* marked with the broken lines in FIG. 16 (the state marked with the solid lines in FIG. 15) to the fluctuation state or the fluctuation position P5*w* marked with the solid lines. Since there is a generation of a gap between the front contact surface 56*a* of the second hammer portion 56 and the second heart cam 81*b* by the fluctuation in the direction W1 of the hammer lever 50A, the hammer lever 50A is slightly displaced in the direction J1 so as to fill the gap.

Figure 14:
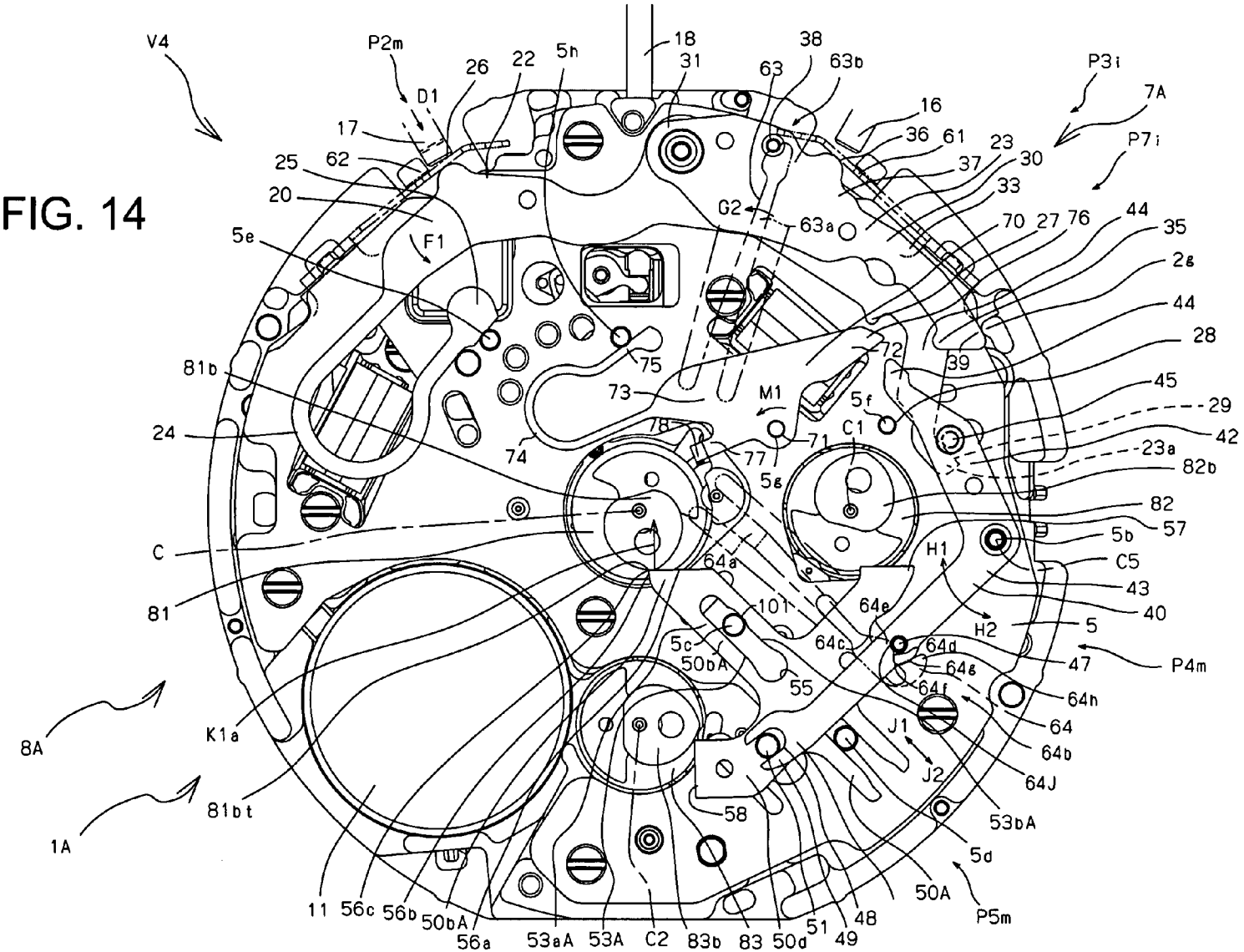
FIG. 14 is a plan view, which is the same as FIG. 13, illustrating a state of escaping the state shown in FIG. 13 in the chronograph timepiece in FIG. 13.
Figure 16:
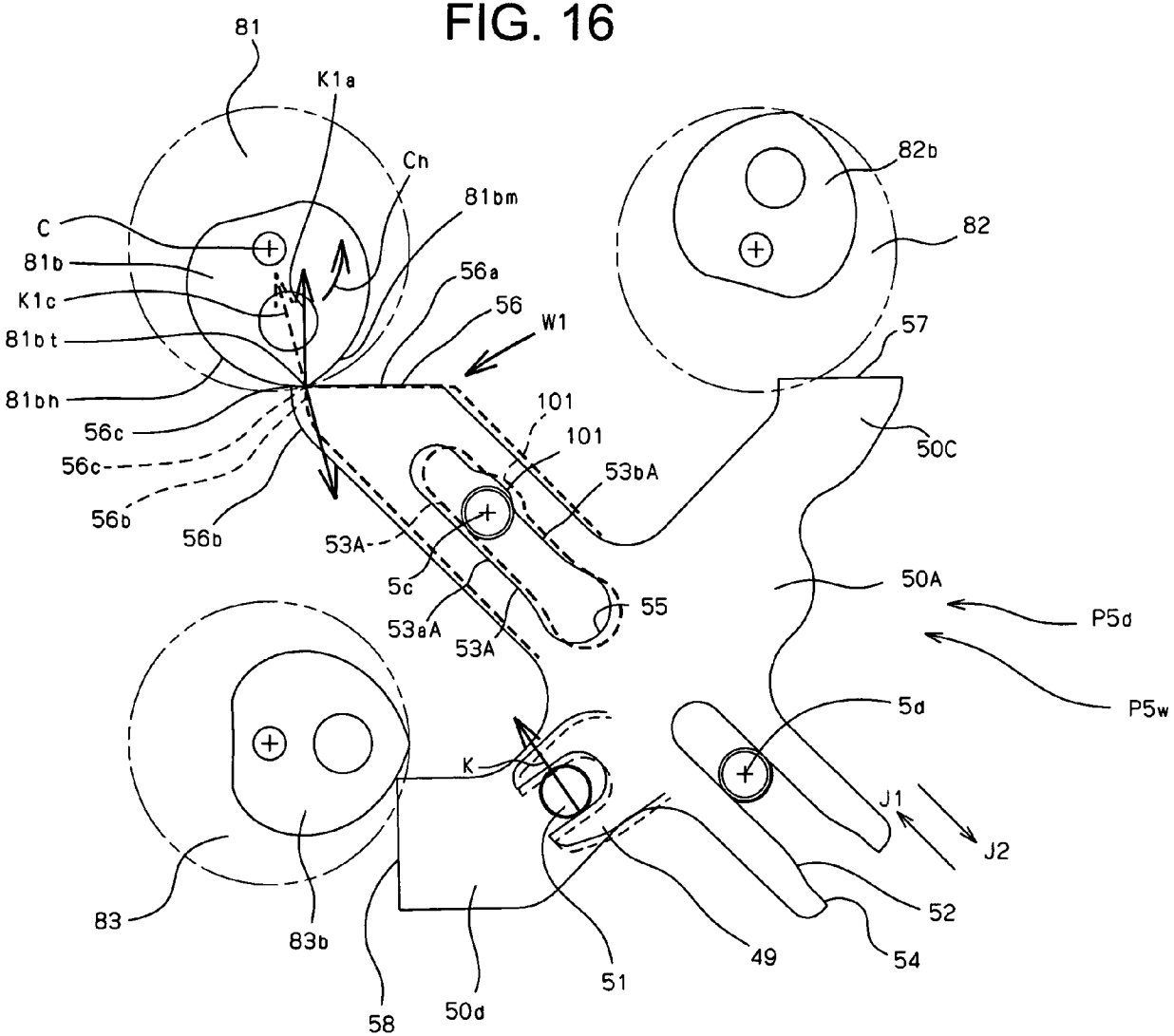
FIG. 16 is an enlarged plan view of the extracted hammer lever and the heart cam parts in the state shown in FIG. 14, which is same as FIG. 15.

If the hammer lever 50A reaches the fluctuation position P5*w*, as can be seen from FIG. 16, the front contact surface 56*a* of the second hammer 56 of the hammer lever 50A comes into contact with the left surface 81*bh* of the tip 81*bt* of the second heart cam 81*b* which is tilted leftwards (counterclockwise rotation) with respect to the contact surface 56*a*. Therefore, as can be seen from FIG. 16 and FIG. 14 showing the entirety, the second hammer 56 of the hammer lever 50A which has escaped from the strut state presses the left surface 81*bh* of the second heart cam 81*b* through the front contact surface 56*a* in the direction of deviating from the center C with the force K1*a*, and the reset-to-zero instruction process restarts and progresses in which the second heart cam 81*b* rotates around the central axis line C in the direction Ch. Thereafter, the self-alignment is performed and thereby the reset-to-zero instruction completion state or the reset-to-zero completion state V4 as shown in FIG. 6 is reached.

In the above description, although the example where the strut state V4*d* comes in which (the tip 56*c* of) the second hammer 56 exactly comes into contact with the tip 81*bt* of the second heart cam 81*b* and presses the tip towards the center C is described, this is true of a case where the strut state comes in which (the tip 58*c* of) the hour hammer 58 exactly comes into contact with the tip 83*bt* of the hour heart cam 83*b* and presses the tip towards the center C2 of the hour heart cam 83*b*. That is, in the chronograph timepiece 1A, since the force with which the hammer lever 50A is applied gives a torque in the direction W1 around the pin 5*d*, the front hammer lever guide pin 5*c* enters the concave portion 101. Therefore, in the same manner as the case shown in FIGS. 15 and 16, the hammer lever 50A fluctuates in the direction W1 so as to escape from the strut state, and thus the reset-to-zero instruction process restarts.

On the other hand, in a case where the strut state comes in which (the tip 57*c*) of the minute hammer 57 exactly comes into contact with the tip 82*bt* of the minute heart cam 82*b* and presses the tip towards the center C1 of the minute heart cam 82*b*, since the guide pins 5*c* and 5*d*, the minute heart cam 82*b*, and the minute hammer 57 lie at relative positions, the hammer lever 50A is applied with a torque around the hammer lever guide pin 5*d* in the direction W2 opposite to the direction W1. Thus, in order to allow the fluctuation in the direction W2, as marked with the virtual line 102 in FIG. 15, a concave portion may be formed in the location Ua (facing the location Ub) of the lateral surface 53*a*A opposite to the lateral surface 53*b*A. Therefore, the guide elongated hole portion 53A of the trunk-tail portion side arm portion 50*b*A may be provided with both of the concave portion 101 and the concave portion 102, or, if necessary, may be provided with only the concave portion 102 instead of the concave portion 101.

Also, if the chronograph wheel rapidly rotates due to the hammer at the time of the reset-to-zero action and then suddenly stops at the time of completion of the reset-to-zero action (or if this sudden stop is repeated), in some cases, there is a problem in that the second chronograph hands including long and thin indication hands are bent because of rapid torque changes, or a skirt-shaped portion or a tube-shaped portion for installment of the second chronograph hands varies in the coupling with the second chronograph stems. In order to suppress such a problem to the minimum and use thin ones as the indication hands or the like of the second chronograph hands, as shown in FIG. 17, in a chronograph timepiece 1B, the movement speed of the hammer is preferably reduced at the time of the reset-to-zero instruction.

Figure 17:
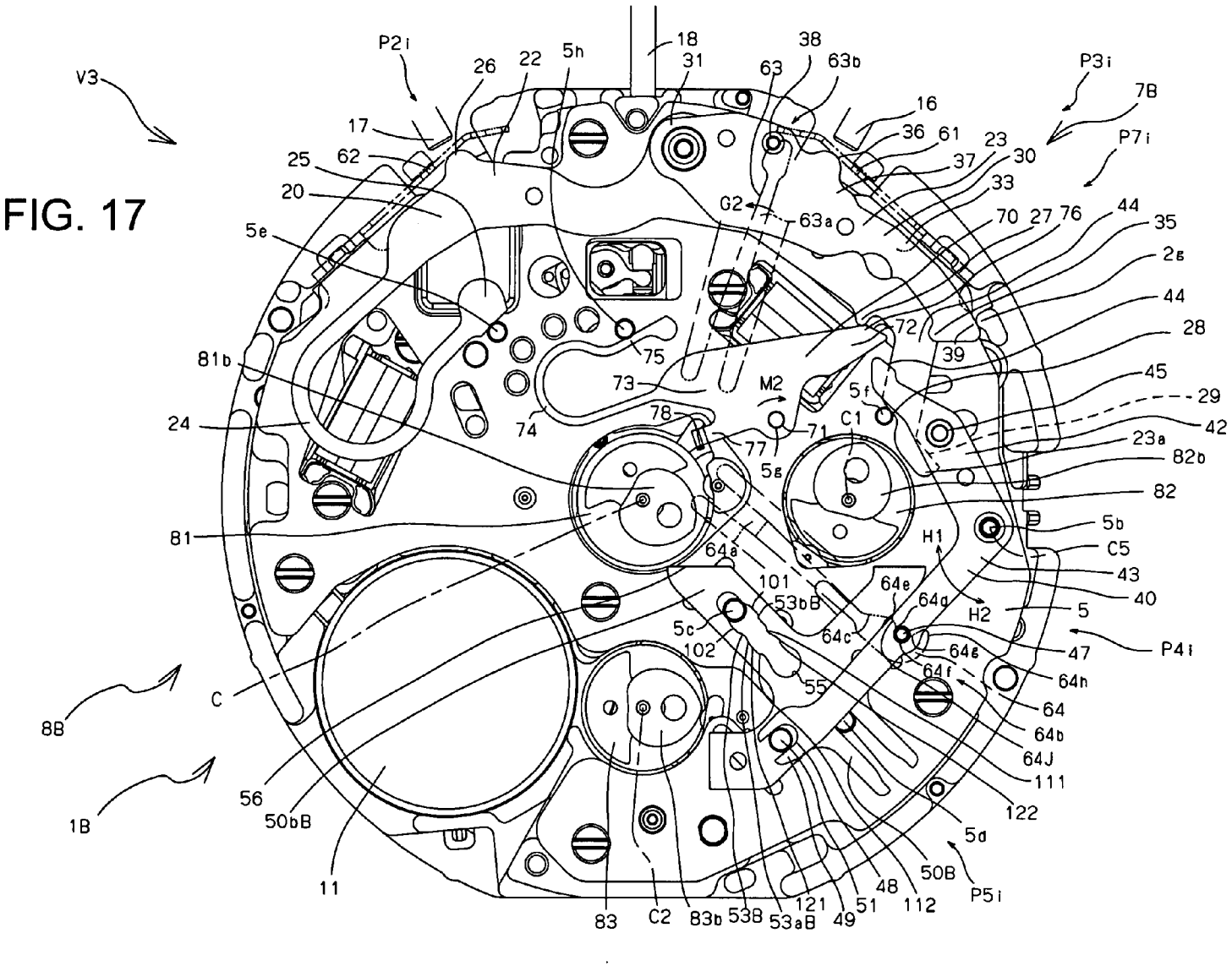
FIG. 17 is a plan view illustrating the same state as in FIG. 5 (chronograph measurement state or measurement stopped state) in a chronograph timepiece according to a still another preferable embodiment of the present invention which can reduce the speed of the hammer lever before the reset-to-zero process is completed.

In the chronograph timepiece 1B in FIG. 17, the same reference numerals are given to the same elements as those shown in FIGS. 1 to 12, and although different, a subscript B is added in the last of the same reference numerals in the corresponding elements. However, in the chronograph timepiece 1B in FIG. 17, although not shown in FIGS. 1 to 12, the same reference numerals as in FIGS. 13 to 16 are given to the same elements as those shown in FIGS. 13 to 16.

In the chronograph timepiece 1B, convex portions or protrusions 111 and 121 are formed in lateral surfaces 53*a*B and 53*b*B of a guide elongated hole portion 53B positioned in a trunk-tail portion side arm portion 50*b*B of a hammer lever 50B. When the hammer lever 50B performs the reset-to-zero action in the direction J1, the protrusions 111 and 121 hinder the linear movement of the hammer lever guide pin 5*c* which moves in the longitudinal direction of the elongated hole 53B inside the guide elongated hole 53B so as to a little change its path, and thus decreases the movement speed of the hammer lever 50B. The chronograph timepiece 1B includes the concave portion 101 and the concave portion 102 opposite thereto.

In addition, since the width of the guide elongated hole 53B is roughly the same as the thickness (diameter) of the hammer lever guide pin 5*c*, in order to give a width corresponding to the thickness (diameter) of the hammer lever guide pin 5*c* according to the protruding of the convex portions 111 and 121, concave portions 112 and 122 are formed in the lateral surfaces facing the convex portions 111 and 121 in the guide elongated hole 53B. In other words, the concave portion 112 is formed in the location facing the convex portion 111 of the lateral surface 53*a*B in the lateral surface 53*b*B, and the concave portion 122 is formed in the location facing the convex portion 121 of the lateral surface 53*b*B in the lateral surface 53*a*B. The convex portion 111 and the concave portion 112 give a width together so as to allow the guide pin 5*c* to move, and the convex portion 121 and the concave portion 112 give a width together so as to allow the guide pin 5*c* to move. However, in a case where a gap between the guide elongated hole 53B and the guide pin 5*c* is relatively large, and the guide pin 5*c* is movable inside the guide elongated hole 53B even when the convex portions 111 and 121 are formed, the concave portion 112 and 122 may be omitted.

In the chronograph timepiece 1B having the chronograph timepiece main body 8B including the mechanical chronograph mechanism 7B configured as described above, from the chronograph measurement state to the chronograph measurement stopped state V3, in the same manner as the case in FIG. 5 regarding the chronograph timepiece 1, as shown in FIG. 17, the reset-to-zero indication lever 20 reaches the initial position P2*i*, the start-stop lever 30 reaches the initial position P3*i*, and the hammer operating lever 40 reaches the initial position P4*i*, and the hammer lever 50 reaches the initial position P5*i*. At this time, the hammer lever guide pin 5*c* is positioned around the forward end of the hammer lever guide elongated hole portion 53B in the direction J1.

Figure 18:
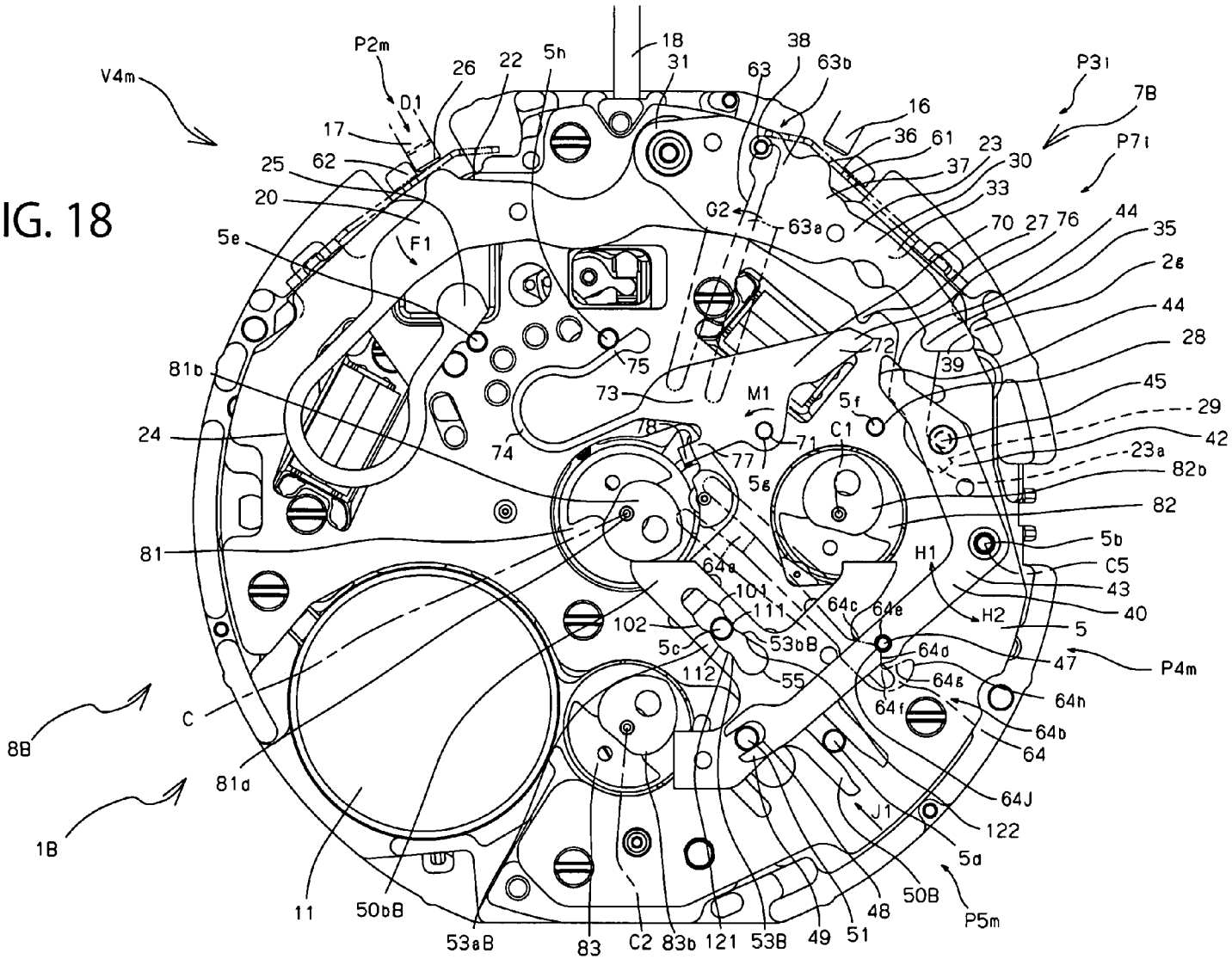
FIG. 18 is a plan view illustrating a state where the reset-to-zero action where the speed of the hammer lever is reduced is performed halfway in the chronograph timepiece shown in FIG. 17.

Here, as shown in FIG. 18, if the reset-to-zero button 17 is forced to be inserted in the direction D1, the reset-to-zero indication lever 20 rotates in the direction F1 to reach the middle position P2*m* where it is displaced halfway towards the operating position P2*a*, the hammer operating lever 40 reaches the middle position P4*m* where it is displaced halfway towards the operating position P4*a*, and the hammer lever 50 reaches the middle position P5*m* where it is displaced halfway towards the operating position P5*a*. At this time, for example, the pin-shaped protrusion 47 of the hammer operating lever 40 reaches the vicinity of the tip 64*j* climbing the lateral surface 64*d* of the convex portion 64*e* of the hammer operating lever switch spring portion 64. If the pin-shaped protrusion 47 of the hammer operating lever 40 exceeds the tip 64*j*, the hammer operating lever 40 further rotates in the direction of H1 due to the spring force of the hammer operating lever switch spring portion 64*d* itself. In this state where the hammer operating lever 40 rotates in the direction H1, the hammer operating lever 40 is applied with both of the spring force of the hammer operating lever switch spring portion 64*d* itself and the torque from the reset-to-zero indication lever 20 which is rotated in the direction F1 by the forced insertion in the direction D1 of the reset-to-zero button 17, and thus the rotation speed in the direction H1 is easily increased.

However, in the chronograph timepiece 1B, as shown in FIG. 18, in this state, the hammer lever guide pin 5*c* moves in the direction J1, comes into contact with the convex portion 111 of the guide elongated hole portion 53B of the hammer lever 50B lying in the middle state P5*m*, and vibrates towards the concave portion 112 and reduces its speed since the linear movement is hindered. Thereafter, it comes into contact with the convex portion 121 in the vibrating side (opposite side) and its linear movement is hindered, thereby vibrating towards the concave portion 122 and reducing its speed.

Therefore, when the reset-to-zero action is further performed and the second hammer portion 56 strikes the second heart cam 81*b* of the second chronograph wheel 81 such that the reset-to-zero completion state as shown in FIG. 6 comes, the impact which is transmitted to the second chronograph stem 81*d* via the second heart cam 81*b* is reduced. Thus, even when the chronograph second hand 81*a* is very thin and very long, a problem in that a display indication hand portion of the chronograph second hand 81*a* is tilted, or a state where the skirt-shaped or tube-shaped portion for installation is attached by being fitted to the second chronograph stem 81*d* is imperfect, can be reduced.

What is claimed is:

1. A chronograph timepiece comprising:

a plurality of heart cams that are attached by being fitted to a plurality of chronograph stems;

a start-stop button;

a reset-to-zero button;

a start-stop lever that is operated by the start-stop button to undergo rotation around a common rotation center positioned between the start-stop button and the reset-to-zero button in a circumferential direction of a timepiece main body;

a reset-to-zero instruction lever that is operated by the reset-to-zero button to undergo rotation around the common rotation center;

a hammer operating lever having one end that undergoes rotation in a first direction when the start-stop lever rotates by operation of the start-stop button, the one end undergoing rotation in a second direction when the reset-to-zero instruction lever rotates by operation of the reset-to-zero button; and a hammer lever that causes the plurality of heart cams to be reset to zero by bringing hammer portions of the hammer lever into engagement with respective ones of the plurality of heart cams when another end of the hammer operating lever rotates in a reset-to-zero instruction direction according to rotation of the hammer operating lever in the second direction;

wherein the plurality of hammer portions are disengaged from respective ones of the plurality of heart cams when the another end of the hammer operating lever rotates in a start-stop direction according to rotation of the hammer operating lever in the first direction.

2. A chronograph timepiece according to claim 1, wherein the start-stop lever and the reset-to-zero instruction lever are in a relative position in a thickness direction of the timepiece, one lever of the start-stop lever and the reset-to-zero instruction lever is engaged with the one end of the hammer operating lever in an output side end portion of the one lever, and the other lever of the start-stop lever and the reset-to-zero instruction lever is engaged with a pin shaped protruding portion which extends from the one end of the hammer operating lever in a direction intersecting a surface of the hammer operating lever in an output side end portion of the other lever.

3. A chronograph timepiece according to claim 2, further comprising:

a battery which is a driving energy source; and a spring-like metal thin plate that provides a reference potential with respect to a voltage from the battery;

wherein the metal thin plate includes clicked sense providing means for providing a clicked sense corresponding to forced insertions of the start-stop button and the reset-to-zero button during operation of the start-stop lever and the reset-to-zero instruction lever, respectively.

4. A chronograph timepiece according to claim 3, wherein the clicked sense providing means includes: a spring portion that provides a pressing sense of the start-stop button and that has a shoulder portion; and a pin-shaped engagement portion into which the start-stop lever deviates from the shoulder portion of the spring portion when the start-stop lever rotates by operation of the start-stop button.

5. A chronograph timepiece according to claim 4, wherein the start-stop lever is configured to undergo rotation to be locked in a locking portion positioned at an outer periphery of a support substrate.

6. A chronograph timepiece according to claim 3, wherein the clicked sense providing means includes a spring portion that sets a position of the hammer operating lever and that has a convex portion, wherein the hammer operating lever includes a pin-shaped protrusion that is positioned at one side of the convex portion of the spring portion in a start-stop control position where the hammer portions of the hammer lever are disengaged from a respective one of the plurality of heart cams, and that is positioned at another side of the convex portion of the spring portion in a reset-to-zero operating control position where the hammer portions of the hammer lever come into contact with a respective one of the plurality of heart cams, and wherein when the pin-shaped protrusion overcomes the convex portion of the spring portion, the spring portion is elastically deformed.

7. A chronograph timepiece according to claim 6, wherein the reset-to-zero button is configured to be inserted into and retracted from an orifice formed in a case of the chronograph timepiece, and wherein in a case where the pin-shaped protrusion of the hammer operating lever is positioned at the other side of the convex portion of the spring portion in order to maintain the hammer portions of the hammer lever at the reset-to-zero operating control position for contact with the respective ones of the plurality of heart cams, when the reset-to-zero button is forced to be inserted to a maximum and the reset-to-zero instruction lever rotates to a maximum, there is a gap between an output side end portion of the reset-to-zero instruction lever and an input side end portion thereof corresponding to the hammer operating lever.

8. A chronograph timepiece according to claim 6, wherein the start-stop button is configured to be inserted into and retracted from an orifice formed in a case of the chronograph timepiece, and wherein in a case where the pin-shaped protrusion of the hammer operating lever is positioned at the one side of the convex portion of the spring portion in order to maintain the hammer portions of the hammer lever at the start-stop control position for being disengaged from the respective ones of the plurality of heart cams, when the start-stop button is forced to be inserted to a maximum and the start-stop lever rotates to a maximum, there is a gap between an output side end portion of the start-stop lever and an input side end portion thereof corresponding to the hammer operating lever.

9. A chronograph timepiece according to claim 1, wherein the start-stop lever, the reset-to-zero instruction lever, the hammer operating lever, and the hammer lever are arranged between a lower plate and a switch spring, when seen from the thickness direction of the chronograph timepiece.

10. A chronograph timepiece according to claim 1, further comprising a stop lever that rotates according to rotation of the reset-to-zero instruction lever when the reset-to-zero button is pressed to set a chronograph train wheel.

11. A chronograph timepiece according to claim 10, wherein the chronograph train wheel includes a second chronograph wheel having a slip mechanism and an intermediate wheel that transmits rotation of a motor to the second chronograph wheel, the second chronograph wheel being configured to set the intermediate wheel.

12. A chronograph timepiece according to claim 1, wherein a position of the hammer lever is determined by a self-alignment action performed by the hammer lever in such a manner that a force which is applied to the hammer lever from the hammer operating lever is balanced with a force which is applied to the plurality of hammer portions of the hammer lever from a respective one of the plurality of heart cams, thereby causing the plurality of heart cams to be reset to zero.

13. A chronograph timepiece according to claim 1, wherein the hammer lever includes a force input portion that is applied with a force from the hammer operating lever, wherein the chronograph timepiece further includes a displacement guide mechanism that guides a displacement of the hammer lever when the hammer lever is applied with a force from the hammer operating lever via the force input portion, wherein the displacement guide mechanism includes two guide pins and guide elongated hole shaped portions to which the respective guide pins are fitted, and wherein one of the two guide elongated hole shaped portions includes a concave portion that allows the guide pin to be displaced in a direction intersecting a longitudinal direction of the one guide elongated hole shaped portion, at a lateral surface in the longitudinal direction of the one guide elongated hole shaped portion in a region where the corresponding guide pin is positioned inside the one guide elongated hole shaped portion, when the hammer portions of the hammer lever come into contact with tips of respective ones of the plurality of heart cams.

14. A chronograph timepiece according to claim 13, wherein each of the guide pins is provided in a support substrate of the chronograph timepiece in a protruding manner, and wherein each of the guide elongated hole shaped portions is formed in the hammer lever.

15. A chronograph timepiece according to claim 13, wherein the concave portion is formed in a surface of the one guide elongated hole shaped portion.

16. A chronograph timepiece according to claim 13, wherein each of the guide elongated hole shaped portions of the displacement guide mechanism includes a braking convex portion that protrudes towards a center of the guide elongated hole shaped portion from the lateral surface of the guide elongated hole shaped portion in order to hinder the guide pins fitted to the guide elongated hole shaped portion from being relatively displaced in the longitudinal direction of the guide elongated hole shaped portion such that a braking force is applied to the hammer lever, when the hammer lever approaches a reset-to-zero position where contact surface portions of the hammer portions of the hammer lever come into contact with minimal diameter contact portions of a respective one of the plurality of heart cams.

17. A chronograph timepiece according to claim 2, wherein the hammer operating lever has a thin plate-shaped form.

* * * * *